US008863843B2

(12) United States Patent
Wu et al.

(10) Patent No.: US 8,863,843 B2
(45) Date of Patent: Oct. 21, 2014

(54) HYDRAULIC ACTUATION OF A DOWNHOLE TOOL ASSEMBLY

(75) Inventors: Jian Wu, Spring, TX (US); Jianbing Hu, Houston, TX (US); Dwayne P Terracina, Spring, TX (US); Tommy G Ray, Spring, TX (US)

(73) Assignee: Smith International, Inc., Houston, TX (US)

( * ) Notice: Subject to any disclaimer, the term of this patent is extended or adjusted under 35 U.S.C. 154(b) by 412 days.

(21) Appl. No.: 13/112,326

(22) Filed: May 20, 2011

(65) Prior Publication Data

US 2011/0284233 A1 Nov. 24, 2011

Related U.S. Application Data

(60) Provisional application No. 61/347,318, filed on May 21, 2010.

(51) Int. Cl.
*E21B 34/00* (2006.01)
*E21B 10/32* (2006.01)
*E21B 23/00* (2006.01)

(52) U.S. Cl.
CPC ..... *E21B 23/006* (2013.01); *E21B 10/32* (2013.01)
USPC ..... 166/321; 166/319; 166/320

(58) Field of Classification Search
None
See application file for complete search history.

(56) References Cited

U.S. PATENT DOCUMENTS 2,069,482 A 2/1937 Seay
3,224,507 A 12/1965 Cordary
3,425,500 A 2/1969 Fuchs
3,556,233 A 1/1971 Lafayette et al.
4,055,226 A 10/1977 Weber
4,458,761 A 7/1984 Van Vreeswyk
4,491,187 A * 1/1985 Russell ..... 175/325.2
4,540,941 A 9/1985 Walkow
4,660,657 A 4/1987 Furse et al.
4,714,116 A 12/1987 Brunner (Continued)

FOREIGN PATENT DOCUMENTS

BE 09900163 12/2000
EP 246789 11/1987

(Continued)

OTHER PUBLICATIONS

International Preliminary Report on Patentability issued in PCT/US2011/037340 on Dec. 6, 2012, 5 pages.

(Continued)

*Primary Examiner* — Jennifer H Gay
*Assistant Examiner* — Caroline Butcher

(57) ABSTRACT

A downhole tool assembly is configured for repeated and selective hydraulic actuation and deactuation. A piston assembly is configured to reciprocate axially in a downhole tool body. The piston assembly reciprocates between a first axial position and second and third axial positions that axially oppose the first position. The downhole tool is actuated when the piston assembly is in the third axial position and deactuated when the piston assembly is in either of the first or second axial positions. A spring member biases the piston assembly towards the first axial position while drilling fluid pressure in the tool body urges the piston assembly towards the second and third axial positions. Downhole tool actuation and deactuation may be controlled from the surface, for example, via cycling the drilling fluid flow rate.

30 Claims, 15 Drawing Sheets

(56) References Cited

U.S. PATENT DOCUMENTS

| | | | | |
|---|---|---|---|---|
| 4,842,083 | A | 6/1989 | Raney | |
| 4,848,490 | A | 7/1989 | Anderson | |
| 5,014,780 | A | 5/1991 | Skipper | |
| 5,060,736 | A | 10/1991 | Neff | |
| 5,139,098 | A | 8/1992 | Blake | |
| 5,293,945 | A | 3/1994 | Rosenhauch et al. | |
| 5,318,137 | A | 6/1994 | Johnson et al. | |
| 5,318,138 | A | 6/1994 | Dewey et al. | |
| 5,332,048 | A | 7/1994 | Underwood et al. | |
| 5,368,114 | A | 11/1994 | Tandberg et al. | |
| 5,443,129 | A | 8/1995 | Bailey et al. | |
| 5,518,073 | A | 5/1996 | Manke et al. | |
| 5,765,653 | A | 6/1998 | Doster et al. | |
| 5,788,000 | A | 8/1998 | Maury et al. | |
| 5,971,085 | A | 10/1999 | Colebrook | |
| 6,039,131 | A | 3/2000 | Beaton | |
| 6,059,051 | A | 5/2000 | Jewkes et al. | |
| 6,213,226 | B1 | 4/2001 | Eppink et al. | |
| 6,227,312 | B1 | 5/2001 | Eppink et al. | |
| 6,269,893 | B1 | 8/2001 | Beaton et al. | |
| 6,289,911 | B1 | 9/2001 | Majkovic | |
| 6,289,999 | B1 | 9/2001 | Dewey et al. | |
| 6,360,831 | B1 | 3/2002 | Aakesson et al. | |
| 6,374,918 | B2 | 4/2002 | Roberts et al. | |
| 6,378,632 | B1 | 4/2002 | Dewey et al. | |
| 6,494,272 | B1 | 12/2002 | Eppink et al. | |
| 6,732,817 | B2 | 5/2004 | Dewey et al. | |
| 7,048,078 | B2 | 5/2006 | Dewey et al. | |
| 7,281,584 | B2 | 10/2007 | McGarian et al. | |
| 7,314,099 | B2 | 1/2008 | Dewey et al. | |
| 7,383,881 | B2 * | 6/2008 | Telfer | 166/212 |
| 7,445,059 | B1 | 11/2008 | Falgout | |
| 2001/0047872 | A1 | 12/2001 | Roberts et al. | |
| 2003/0111267 | A1 | 6/2003 | Pia | |
| 2003/0146023 | A1 | 8/2003 | Pia | |
| 2004/0134687 | A1 | 7/2004 | Radford et al. | |
| 2004/0134689 | A1 | 7/2004 | Fujii | |
| 2007/0089912 | A1 | 4/2007 | Eddison | |
| 2007/0095573 | A1 | 5/2007 | Telfer | |
| 2007/0102163 | A1 | 5/2007 | Heath | |
| 2008/0110678 | A1 | 5/2008 | Radford | |
| 2008/0128175 | A1 * | 6/2008 | Radford et al. | 175/269 |
| 2009/0032308 | A1 | 2/2009 | Eddison | |
| 2010/0089583 | A1 * | 4/2010 | Xu et al. | 166/298 |

FOREIGN PATENT DOCUMENTS

| | | | |
|---|---|---|---|
| EP | 301890 | | 2/1989 |
| EP | 594420 | | 4/1994 |
| GB | 2305681 | | 4/1997 |
| GB | 2344122 | A | 5/2000 |
| WO | 0031371 | | 6/2000 |
| WO | 2007144719 | | 12/2007 |
| WO | WO 2009024753 | A1 * | 2/2009 |

OTHER PUBLICATIONS

90/012,910, Jul. 3, 2013, Dewey Charles H et al., Reexamination of US 7,314,099.

90/012,912, Jul. 3, 2013, Dewey Charles H et al., Reexamination of US 6,732,817.

British Search Report for Application No. GB0302983.2 having a date of search of Jun. 6, 2003.

French Search Report for Application No. FR0301965 having a date of search of Feb. 4, 2005.

* cited by examiner

HYDRAULIC ACTUATION OF A DOWNHOLE TOOL ASSEMBLY

RELATED APPLICATIONS

This application claims the benefit of U.S. Provisional Application Ser. No. 61/347,318 entitled "Reamer on Demand Actuator", filed May 21, 2010.

FIELD OF THE INVENTION

The present invention relates generally to a hydraulic actuation mechanism for use in downhole tools. More specifically, the invention relates to a hydraulic actuation assembly enabling a substantially unlimited number of actuation and deactuation cycles of a downhole tool, such as a reamer, without having to break or trip a tool string.

BACKGROUND OF THE INVENTION

Downhole drilling operations commonly require a downhole tool to be actuated after the tool has been deployed in the borehole. For example, underreamers are commonly tripped into the borehole in a collapsed state (i.e., with the cutting structures retracted into the underreamer tool body). At some predetermined depth, the underreamer is actuated such that the cutting structures expand radially outward from the tool body. Hydraulic actuation mechanisms are well known in oilfield services operations and are commonly employed, and even desirable, in such operations.

For example, one well-known hydraulic actuation methodology involves wireline retrieval of a plug (or "dart") through the interior of the drill string to enable differential hydraulic pressure to actuate an underreamer. Upon completion of the reaming operation, the underreamer may be deactuated by redeploying the dart. While commercially serviceable, such wireline actuation and deactuation is both expensive and time-consuming in that it requires concurrent use of wireline or slickline assemblies.

Another commonly used hydraulic actuation methodology makes use of shear pins configured to shear at a specific differential pressure (or in a predetermine range of pressures). Ball drop mechanisms are also known in the art, in which a ball is dropped down through the drill string to a ball seat. Engagement of the ball with the seat typically causes an increase in differential pressure which in turn actuates the downhole tool. The tool may be deactuated by increasing the pressure beyond a predetermined threshold such that the ball and ball seat are released (e.g., via the breaking of shear pins). While such sheer pin and ball drop mechanisms are also commercially serviceable, they are generally one-time or one-cycle mechanisms and do not typically allow for repeated actuation and deactuation of a downhole tool.

Various other hydraulic actuation mechanisms make use of measurement while drilling (MWD) and/or other electronically controllable systems including, for example, computer controllable solenoid valves and the like. Electronic actuation advantageously enables a wide range of actuation and deactuation instructions to be executed and may further enable two-way communication with the surface (e.g., via conventional telemetry techniques). However, these actuation systems tend to be highly complex and expensive and can be severely limited by the reliability and accuracy of MWD, telemetry, and other electronically controllable systems deployed in the borehole. As a result, there are many applications ins which their use tends to be undesirable.

There remains a need in the art for a hydraulic actuation assembly that enables a downhole tool, such as an underreamer, to be actuated and deactuated substantially any number of times during a drilling operation without breaking the tool string and/or tripping the tool out of the borehole. Such an assembly is preferably purely mechanical and therefore does not require the use of electronically controllable components.

SUMMARY OF THE INVENTION

Exemplary aspects of the present invention are intended to address the above described need for an improved hydraulic actuation mechanism. Aspects of the invention include a downhole tool assembly that may be repeatedly and selectively hydraulically actuated and deactuated without breaking or tripping the tool string. Tool embodiments in accordance with the present invention include a piston assembly configured to reciprocate axially in a downhole tool body. The piston assembly reciprocates between a first axial position and second and third axial positions that axially oppose the first axial position. The downhole tool is actuated when the piston assembly is in the third axial position and deactuated when the piston assembly is in either of the first or second axial positions. A spring member biases the piston assembly towards the first axial position while drilling fluid pressure in the tool body urges the piston assembly against the spring bias and towards the second and third axial positions. Downhole tool actuation and deactuation may be controlled from the surface, for example, via cycling the drilling fluid flow rate.

Exemplary embodiments of the present invention advantageously provide several technical advantages. For example, the present invention enables a downhole tool to be selectively and repeatedly actuated and deactuated substantially any number of times without breaking the drill string and/or or tripping the tool out of the borehole. The invention further obviates the need for physical actuation and deactuation (e.g., including the use of darts, ball drops, and the like).

Moreover, embodiments of the invention advantageously allow a downhole tool to be in a deactuated state while providing full drilling fluid flow through the tool. In certain exemplary embodiments of the invention unobstructed flow may be advantageously provided through a central bore. This tends to minimize both the pressure drop through the tool and erosion of internal tool components during use. Being purely mechanical (not requiring the use of any electronic monitoring or control), downhole tool assemblies in accordance with the present invention also tend to be highly reliable and serviceable.

Certain embodiments of the invention may also be configured to provide an indication to the surface of the tool actuation/deactuation status, for example, a pressure drop indicating tool actuation. Such an indication tends to advantageously reduce operational uncertainties. Various embodiment of the invention also allow the drilling fluid flow rate to be repeatedly cycled between high and low flow rates without actuating or deactuating the downhole tool. This feature of the invention may also enhance operational certainty as it tends to eliminate inadvertent actuation and deactuation.

In one aspect the present invention includes a downhole tool assembly having a downhole tool body configured for connecting with a drill string. A mandrel including at least one port is deployed in the tool body. A piston assembly having a through bore is deployed in the mandrel. The piston assembly includes at least a valve piston and a cam piston configured to reciprocate axially in the mandrel between a first axial position and second and third axial positions that axially oppose the first axial position. A spring member is deployed in the tool body and is disposed to bias the piston assembly towards the first axial position. The mandrel port is configured to be in fluid communication with the through bore when the piston assembly is in the third axial position and is sealingly engaged with an outer surface of the piston assembly when the piston assembly is in either the first axial position or the second axial position.

In another aspect, the present invention includes a downhole tool assembly. The tool assembly includes a downhole tool body having a through bore and is configured for connecting with a drill string. A cam piston is deployed in the tool body and includes first and second uphole and downhole facing cam profiles formed thereon. The cam piston is configured to reciprocate axially in the tool body between a first axial position in which at least a first guide pin engages the first cam profile and second and third axial positions that axially oppose the first axial position in which at least a second guide pin engages the second cam profile. A spring member is deployed in the tool body and is disposed to bias the cam piston towards the first axial position. A fluid flow path is disposed to be in fluid communication with the through bore when the cam piston is in the third axial position and is disposed to be out of fluid communication when the cam piston is in either the first axial position or the second axial position.

In a further embodiment, the present invention includes a downhole tool assembly having a downhole tool body configured for connecting with a drill string. A mandrel including at least one port is deployed in the tool body. A piston assembly is deployed in the mandrel. The piston assembly has a through bore and includes at least a valve piston and a cam piston configured to reciprocate axially in the mandrel between a first axial position and second and third axial positions that axially oppose the first axial position. A spring member is deployed in the tool body and is disposed to bias the piston assembly towards the first axial position. The valve piston includes at least a first radial port formed therein, the radial port being axially aligned with and in fluid communication with the mandrel port when the piston assembly is in the third axial position. The radial port is axially misaligned with the mandrel port and sealingly engaged with an inner surface of the mandrel when the piston assembly is in either the first axial position or the second axial position.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a more complete understanding of the present invention, and the advantages thereof, reference is now made to the following descriptions taken in conjunction with the accompanying drawings, in which:

FIGS. 5A-8B depict a full actuation cycle for the hydraulically actuated tool assembly shown on FIG. 3 in which FIGS. 5A and 5B depict cross-sectional and side views of corresponding portions of the assembly in a first operational mode;

FIGS. 8A and 8B depict cross-sectional and side views of the same portion of the assembly in a third operational mode.

DETAILED DESCRIPTION

Figure 1:
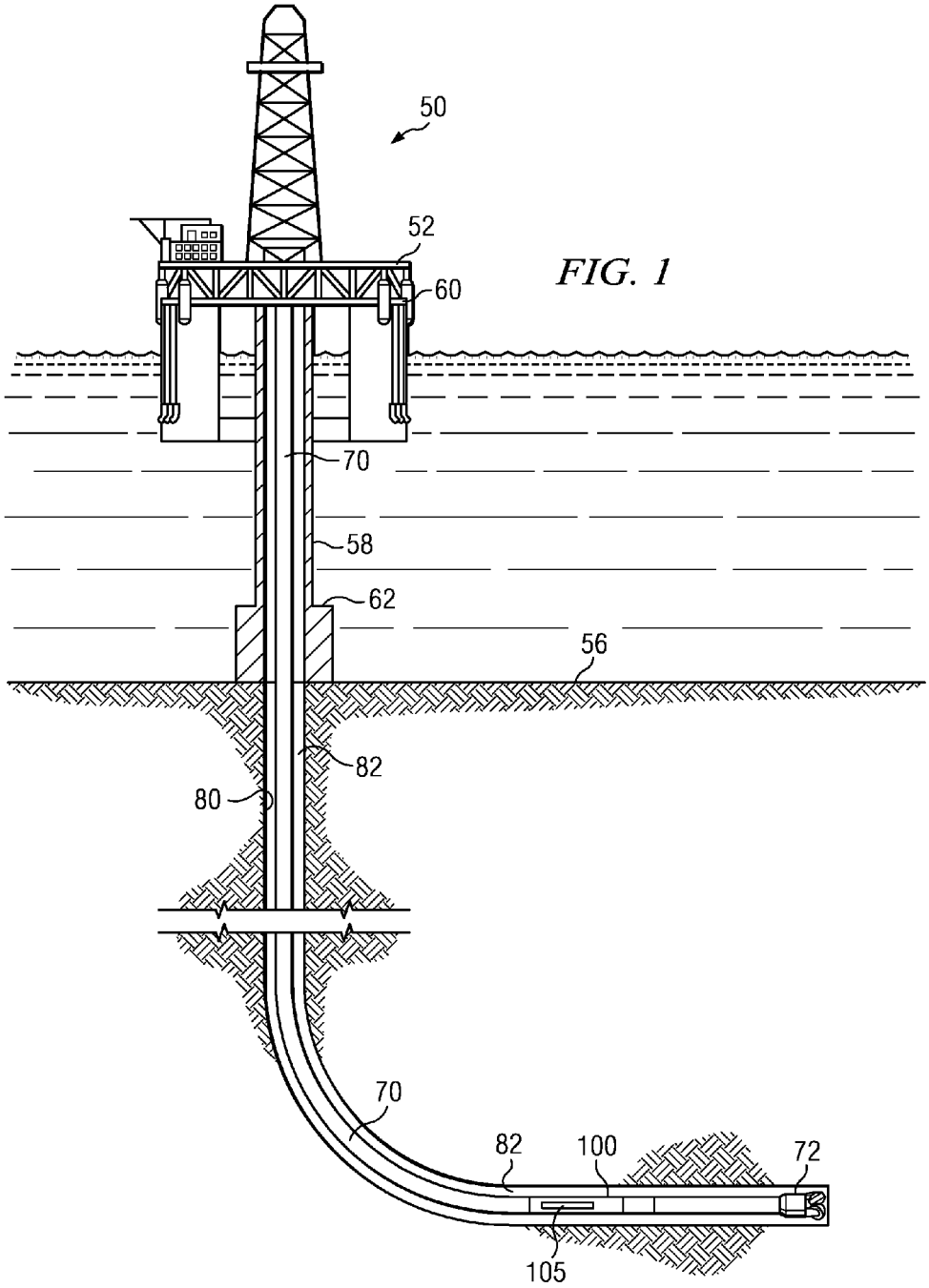
FIG. 1 depicts a conventional drilling rig on which exemplary embodiments in accordance with the present invention may be utilized.

Referring to FIGS. 1 through 17, exemplary embodiments of the present invention are depicted. With respect to FIGS. 1 through 17, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 17 may be described herein with respect to that reference numeral shown on other views.

FIG. 1 depicts an exemplary offshore drilling assembly, generally denoted 50, suitable for use with downhole tool embodiments in accordance with the present invention. In FIG. 1 a semisubmersible drilling platform 52 is positioned over an oil or gas formation (not shown) disposed below the sea floor 56. A subsea conduit 58 extends from deck 60 of platform 52 to a wellhead installation 62. The platform may include a derrick and a hoisting apparatus for raising and lowering the drill string 70, which, as shown, extends into borehole 80 and includes drill bit 72 and a hydraulically actuated tool assembly 100 configured in accordance with the present invention deployed above the bit 72. The drill string 70 may optionally further include substantially any number of other downhole tools including, for example, measurement while drilling (MWD) or logging while drilling (LWD) tools, stabilizers, a drilling jar, a rotary steerable tool, and a downhole drilling motor. The tool assembly 100 may be deployed in substantially any location along the string, for example, just above the bit 72 or further uphole above various MWD and LWD tools. The invention is explicitly not limited in these regards.

During a typical drilling operation, drilling fluid (commonly referred to as "mud" in the art) is pumped downward through the drill string 70 and the bottom hole assembly (BHA) where it emerges at or near the drill bit 72 at the bottom of the borehole. The mud serves several purposes, for example, including cooling and lubricating the drill bit, clearing cuttings away from the drill bit and transporting them to the surface, and stabilizing and sealing the formation(s) through which the borehole traverses. The discharged mud, along with the borehole cuttings and sometimes other borehole fluids, then flow upwards through the annulus 82 (the space between the drill string 70 and the borehole wall) to the surface. In exemplary embodiments of the present invention, the tool assembly makes use of the differential pressure between an internal flow channel and the annulus to selectively actuate and deactuate certain tool functionality (e.g., the radial extension of a cutting structure outward from a tool body).

It will be understood by those of ordinary skill in the art that the deployment illustrated on FIG. 1 is merely exemplary. It will be further understood that exemplary embodiments in accordance with the present invention are not limited to use with a semisubmersible platform 52 as illustrated on FIG. 1. The invention is equally well suited for use with any kind of subterranean drilling operation, either offshore or onshore.

Figure 2A:
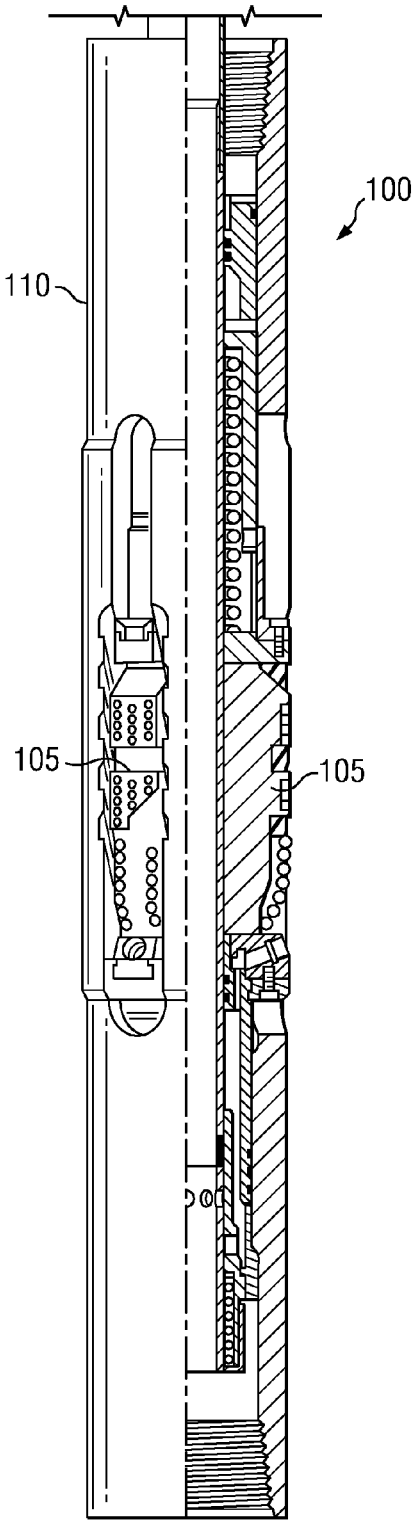
FIGS. 2A and 2B (collectively FIG. 2) depict one exemplary underreamer embodiment in retracted (FIG. 2A) and extended (FIG. 2B) configurations.
Figure 2B:
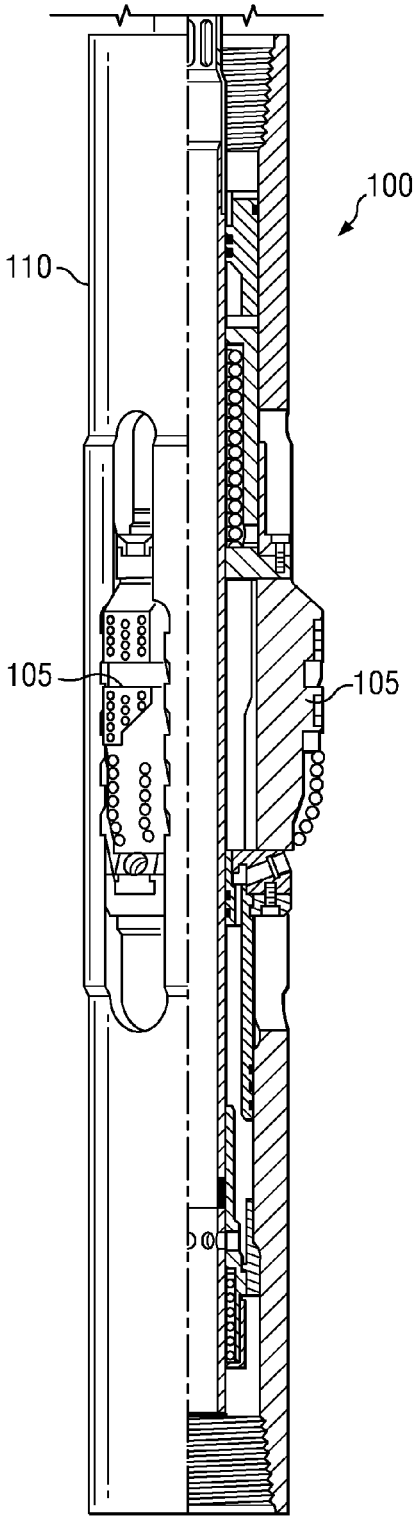

In one exemplary embodiment of the invention, tool assembly 100 may include an underreamer configured for selective hydraulic actuation and deactuation. By actuate and deactuate (or activate and deactivate) it is meant that the reamer cutting structures 105 (referred to herein as blades) may be extended radially outward from the tool body 110 and retracted radially inward towards (or into) the tool body 110. FIGS. 2A and 2B depict one exemplary underreamer embodiment in retracted (i.e., deactivated as shown on FIG. 2A) and extended (activated as shown on FIG. 2B) configurations. In certain prior art tool configurations, the blades may be fully extended when the hydraulic pressure exceeds a predetermined threshold. The blades are spring biased inwards and retract upon removal of the pressure. These prior art reamers may therefore be thought of as having two operational configurations; (i) a low flow (low pressure) configuration in which the blades are retracted and (ii) a high flow (high pressure) configuration in which the blades are extended. There is a need for providing additional configurations, for example, including a high flow (high pressure) configuration in which the blades are retracted and a mechanism for selecting among the various configurations during a drilling/reaming operation.

Embodiments of the present application provide an actuation/deactuation system that enables a downhole tool, such as a reamer, to be actuated and deactuated substantially any number of times without breaking the tool string or tripping it out of the borehole. For example, embodiments of the present application may enable a drilling tool assembly having a reamer disposed on the drill string to drill a portion of the wellbore with the reamer deactivated (with the reamer blades 105 retracted as depicted on FIG. 2A). At some specific (or predetermined) location, the reamer may be activated (with the reamer blades 105 extended as depicted on FIG. 2B) so as to form a wellbore having an increased diameter. The reamer may then be deactivated at substantially any other suitable location and the drill bit alone may be used to drill another length of the wellbore. Substantially any number of such activation/deactivation cycles may be utilized in drilling the wellbore.

It will be understood that tool assembly embodiments in accordance with the present invention are not limited to underreamers such as depicted on FIGS. 2A and 2B. Various embodiments of the invention may be utilized to actuate substantially any downhole tool for which hydraulic actuation and deactuation may be advantageous. Such tools may include hydraulically actuated stabilizers, milling tools, packers, impact tools, and the like. The invention is not limited in this regard.

Figure 3A:
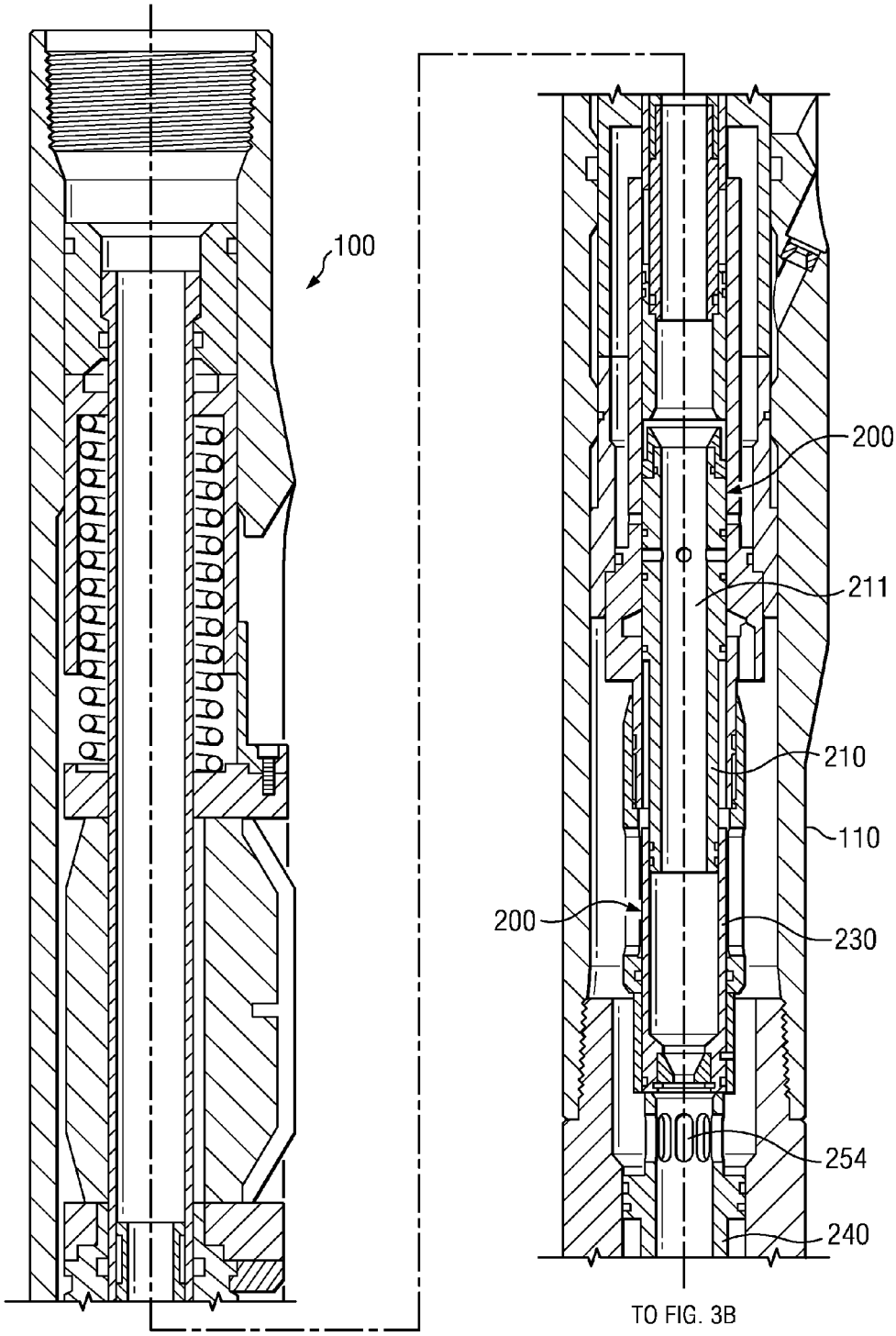
FIGS. 3A and 3B (collectively FIG. 3) depict a longitudinal cross sectional view of a hydraulically actuated tool assembly in accordance with the present invention.
Figure 3B:
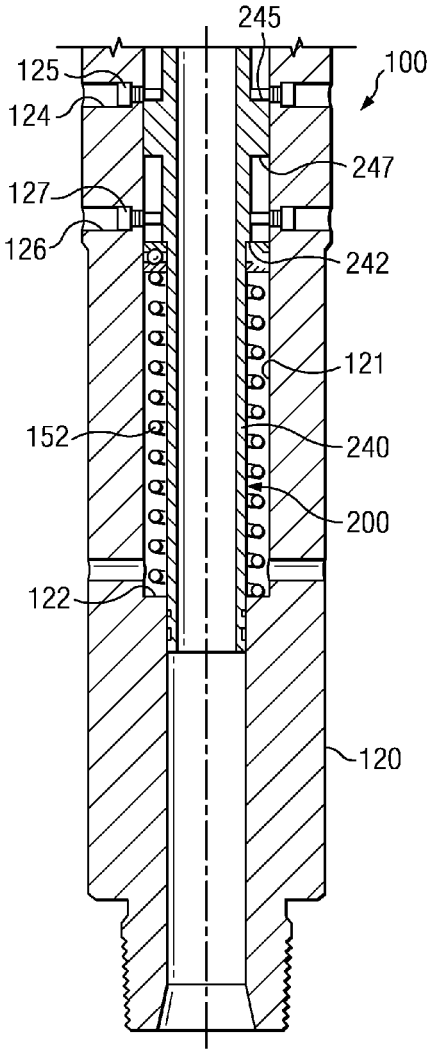

FIG. 3 depicts one exemplary embodiment of a hydraulically actuated tool assembly 100 in accordance with the present invention in longitudinal cross section. In the exemplary embodiment depicted, the tool assembly 100 includes an underreamer tool body 110 connected to a sub body 120. While the embodiments described herein are specific to reamers, it will be understood that embodiments of the invention may be used to activate/deactivate various downhole tools as described above. An axial piston assembly 200 is deployed substantially co-axially in the tool and sub bodies 110 and 120 and is configured to reciprocate axially therein. Piston assembly 200 includes valve piston 210 and cam piston 240 as described in more detail below with respect to FIG. 4. A helical compression spring 152 is deployed axially between external shoulder 242 on the cam piston 240 and internal shoulder 122 on the sub body. In the exemplary embodiment depicted, the spring 152 is configured to bias the piston assembly 200 in the uphole direction (towards the underreamer tool body 110).

The piston assembly 200 is configured to reciprocate between a first low flow position and second and third high (or full) flow positions. In the low flow position, spring force urges assembly 200 in the uphole direction such that an uphole engagement face 245 engages uphole guide pin(s) 125 (as depicted on FIG. 3). In the high flow positions, fluid force exceeds the spring force and urges the assembly 200 in a downhole direction such that a downhole engagement face 247 engages downhole guide pins 127. Engagement surfaces 245 and 247 are formed in and extend around the periphery of cam piston 240 as described in more detail below. The uphole and downhole guide pins 125 and 127 are deployed in corresponding radial bores 124 and 126 formed in sub body 120 and extend radially into the central bore 121 of the sub body 120 where they may engage the corresponding engagement surfaces 245 and 247.

Figure 4:
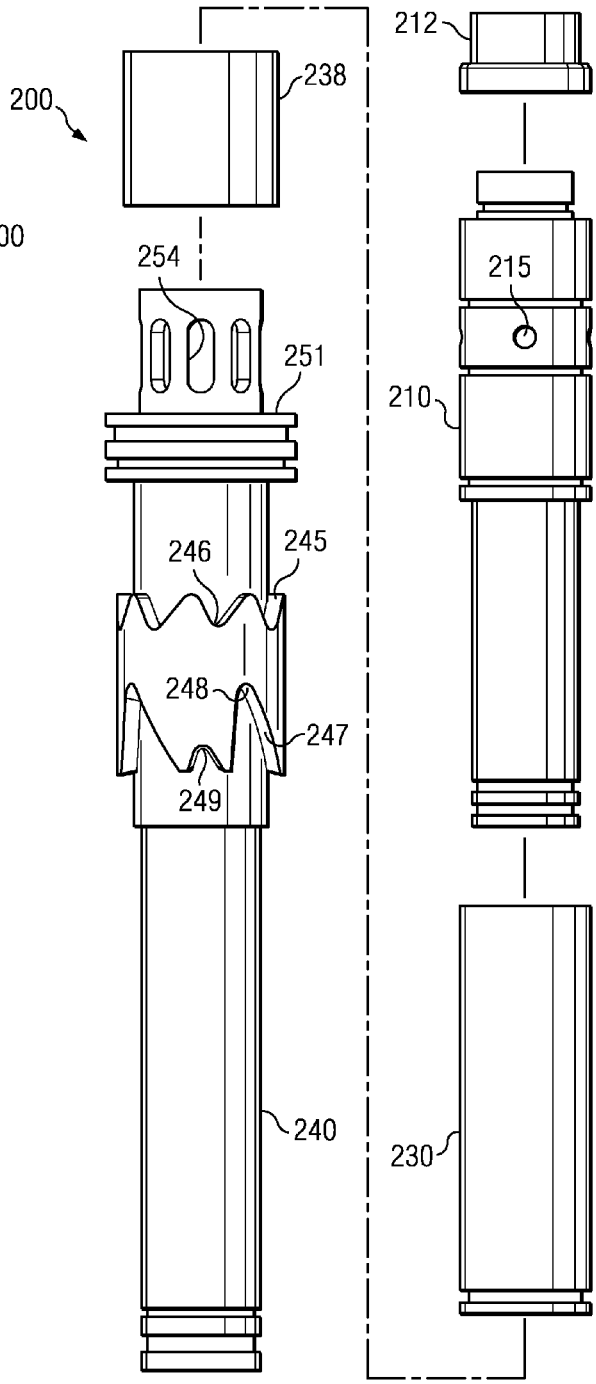
FIG. 4 depicts an exploded view of the piston assembly portion of the embodiment depicted on FIG. 3.

FIG. 4 depicts an exploded view of the exemplary piston assembly 200 depicted on FIG. 3. In the exemplary embodiment depicted, valve piston 210 is deployed axially between a piston cap 212 and a shear sleeve 230. The valve piston 210 may be connected to the piston cap 212 and shear sleeve 230 via shear pins (not shown), although the invention is not limited in this regard. Valve piston 210 includes a plurality of circumferentially spaced ports 215 formed therein that provide fluid communication between central bore 211 (FIG. 3A) and a flow channel external to the valve piston 210.

It will be understood that the invention is not limited to the use of a shear sleeve 230. In alternative embodiments, the valve piston 210 may be coupled to cam piston 240, for example, via locking nut 238. The shear sleeve 230 is intended to provide redundant functionality, allowing for a one-time ball drop actuation. In such embodiments, shear sleeve 230 includes in internal ball seat (not shown) sized and shaped to receive a ball dropped from the surface. Increasing the flow rate (pressure) to a predetermined level shears the pins connecting the valve piston 210 and shear sleeve 230 thereby allowing the downhole end of valve piston 210 to move axially into the shear sleeve 230. In this configuration, drilling fluid may be diverted and the actuated. Again, the invention is not limited in these regards.

With continued reference to FIG. 4, cam piston 240 includes a plurality of apertures 254 formed therein for providing fluid flow into and out of the cam piston 240 (as is described in more detail below). Cam piston 240 further includes uphole and downhole axially facing engagement surfaces 245 and 247 (also referred to herein as engagement profiles) formed in an outer cylindrical surface of the piston 240. In the exemplary embodiment depicted, uphole engagement surface 245 includes a plurality of circumferentially spaced troughs 246 configured for receiving guide pin(s) 125. The downhole engagement surface 247 includes a plurality of circumferentially spaced alternating deep and shallow troughs 248 and 249 configured for receiving guide pins 127. The functionality of these engagement surfaces 245 and 247 are described in more detail below.

It will be understood that substantially any suitable guide pin configuration may be utilized. However guide pins having a substantially flat engagement end are generally preferable in that they enable the pin to support higher engagement forces without shearing. Embodiments that make use of multiple guide pins (e.g., four uphole and four downhole pins circumferentially spaced at 90 degree intervals) are also generally preferable and that they tend to more effectively distribute the engagement forces. Those of ordinary skill in the art will appreciate that the invention is not limited to any particular guide pin configuration or to any particular number or spacing of the guide pins.

Downhole tool actuation and deactuation is now described in more detail with respect to FIGS. 5A through 8B. Generally, the actuation system of the present invention enables a downhole tool to be switched between three different modes of operation. A full actuation/deactuation cycle requires four steps between the three modes of operation: (i) a first step in which the tool is switched from the first mode to the second mode, (ii) a second step in which the tool is switched back to the first mode, (iii) a third step in which the tool is switched from the first mode to the third mode, and (iv) a fourth step in which the tool switched back to the first mode. In the first mode, the tool is in the inactive state with low flow. In the second mode, the tool is also inactive but with high (or full) flow provided. In the third mode, the tool is active with full (or high) flow provided. The terms active and inactive refer to the state of the tool, i.e., whether the tool is in an activated state or a non-activated state. For example, in an embodiment in which the downhole tool is a reamer, the active state may refer to the aforementioned cutting blades being extended, thereby allowing reaming of the formation. The inactive state may refer to the blades being retracted within the tool body, thereby allowing the tool to be run in or out of the borehole or allowing drilling with no reaming. In more general embodiments active and inactive may refer, for example, to the state of a valve being opened or closed. In high or full flow, sufficient drilling fluid typically passes through the actuation system so as to allow for drilling. Low flow refers to a drilling fluid flow rate that is below some predetermined threshold and that is typically insufficient for drilling.

Figure 5A:
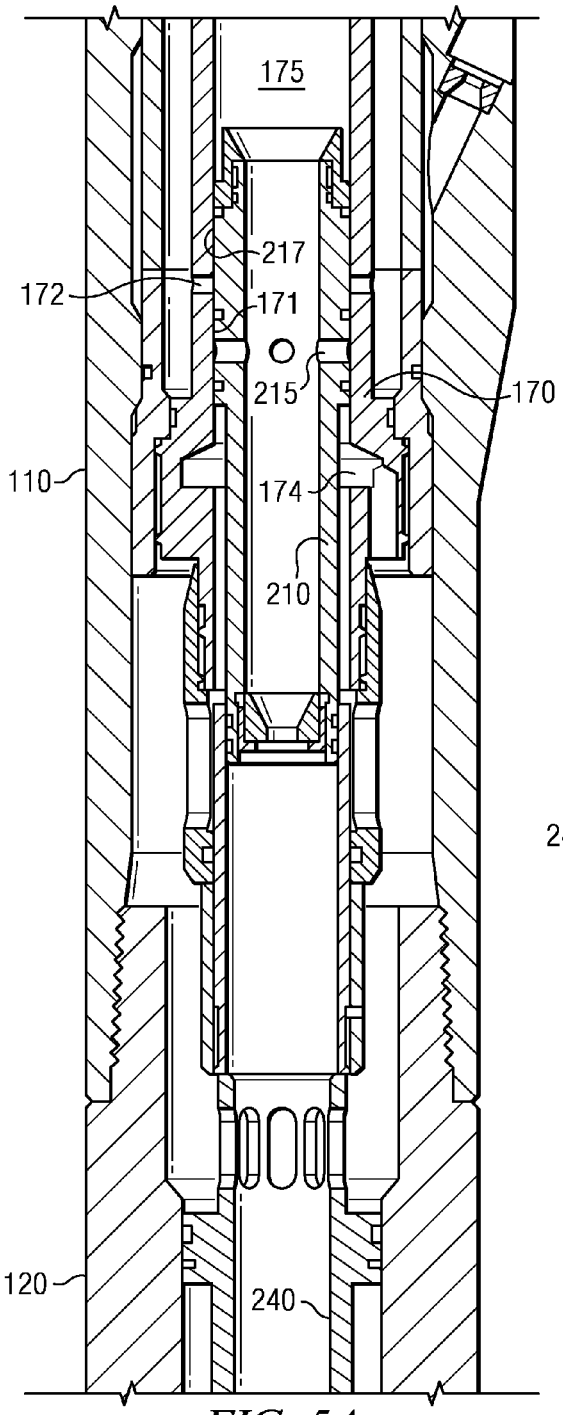
Figure 5B:
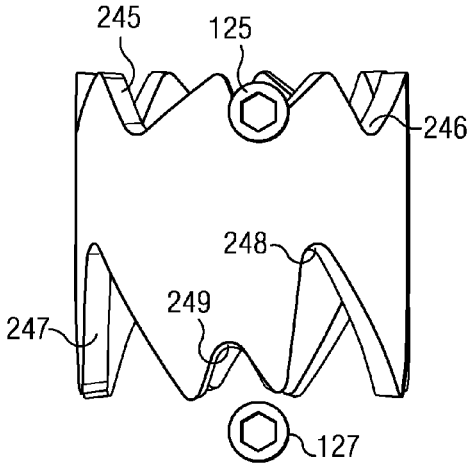

With continued reference to FIGS. 5A through 8B, cross-sectional views of a portion of assembly 100 (FIG. 3) are depicted in various states side by side with corresponding side views of the engagement surfaces 245 and 247 of cam piston 240. In FIGS. 5A and 5B, the assembly is in the first operational mode, in which the tool is inactive and flow is low. In this mode, fluid flow is restricted (or turned off) at the surface. Due to the low flow, compression spring 152 (FIG. 3) urges cam piston 240 in the uphole directions such that uphole guide pins 125 engage corresponding troughs 246 in engagement surface 245. Valve piston 210 is also urged upward with cam piston 240. In the exemplary embodiment depicted activation of the downhole tool requires fluid communication between central bore 175 and mandrel port 172. Breaking fluid communication between the central bore 175 and port 172 deactivates the tool. In the low flow configuration depicted, port 172 sealingly engages outer surface 217 of valve piston 210.

Figure 6A:
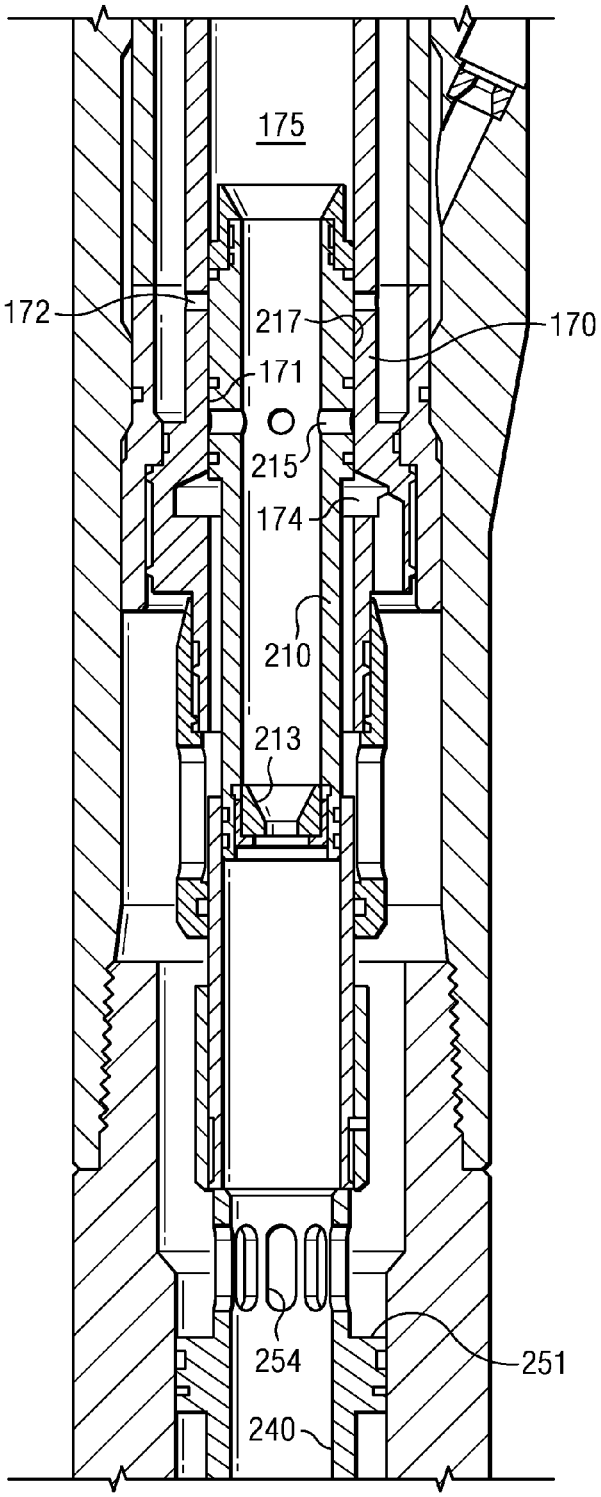
FIGS. 6A and 6B depict cross-sectional and side views of the same portion of the assembly in a second operational mode.
Figure 6B:
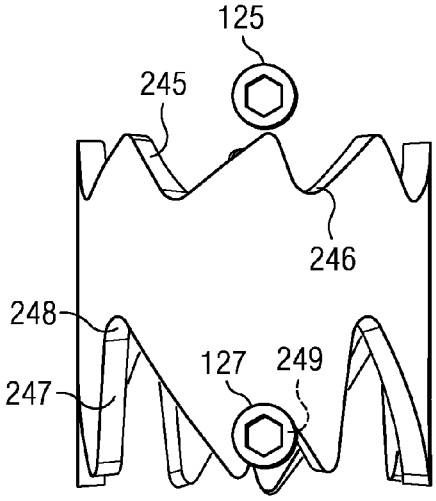

In FIGS. 6A and 6B, the assembly 100 is in the second operational mode, in which full flow is provided but the downhole tool remains deactivated. To switch the assembly to the second mode, high (or full) flow is turned on at the wellbore surface. The increased flow urges valve piston 210 and cam piston 240 in the downhole direction against the spring bias such that downhole guide pins 127 engage corresponding shallow troughs 249 in engagement surface 247. Engagement of the guide pins 127 with surface 247 rotates the cam piston 240 (due to the profile of the surface) until the pins are seated in the corresponding shallow troughs 249. Hydraulic pressure may be communicated, for example, to surface 251 of cam piston 240. Increasing the flow rate (and therefore the pressure differential) beyond a predetermined threshold overcomes the spring bias and urges the cam piston 240 in the downhole direction. In the exemplary embodiment depicted, valve piston 210 and cam piston 240 are not connected to one another and therefore do not rotate together. Hydraulic pressure acting on nozzle 213 urges valve piston 210 and shear sleeve 230 downhole.

Despite valve piston 210 being urged downhole, ports 215 remain sealingly engaged with the inner surface 171 of lower mandrel 170 (i.e., such that they are axially misaligned with mandrel ports 172 and 174). Moreover, as also depicted, mandrel port 172 remains sealingly engaged with the outer surface 217 of valve piston 210. Therefore, the downhole tool remains inactive (in the deactuated state) while substantially full flow is provided through the assembly, for example, to a drill bit for drilling.

Figure 7A:
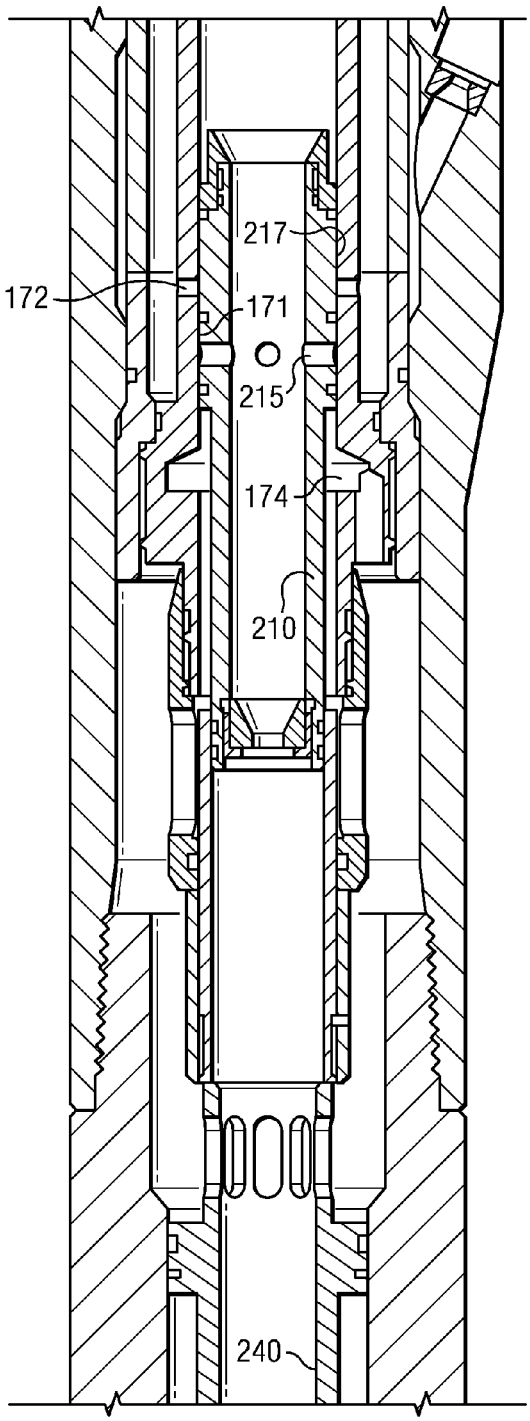
FIGS. 7A and 7B depict cross-sectional and side views of the same portions of the assembly shown in the first operational mode.
Figure 7B:
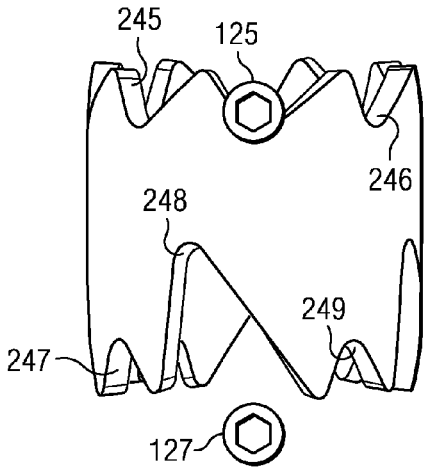

In FIGS. 7A and 7B, the assembly is again shown in the first operational mode (in which the tool is inactive and flow is low). To switch from the second mode depicted on FIGS. 6A and 6B, fluid flow is restricted (or turned off) at the surface. Compression spring 152 (FIG. 3) again urges cam piston 240 in the uphole direction such that uphole guide pins 125 engage corresponding troughs 246 in engagement surface 245. The configuration depicted on FIGS. 7A and 7B is substantially identical to that depicted on FIGS. 5A and 5B with the exception that the cam piston has further rotated such that the guide pins 125 engage adjacent troughs 246 in the engagement surface 245 (which corresponds to a 45 degree rotation in the exemplary embodiment depicted). Ports 215 remain sealingly engaged with the inner surface 171 of lower mandrel 170 and mandrel ports 172 remain sealingly engaged with the outer surface 217 of valve piston 210 such that the tool remains inactive.

Figure 8A:
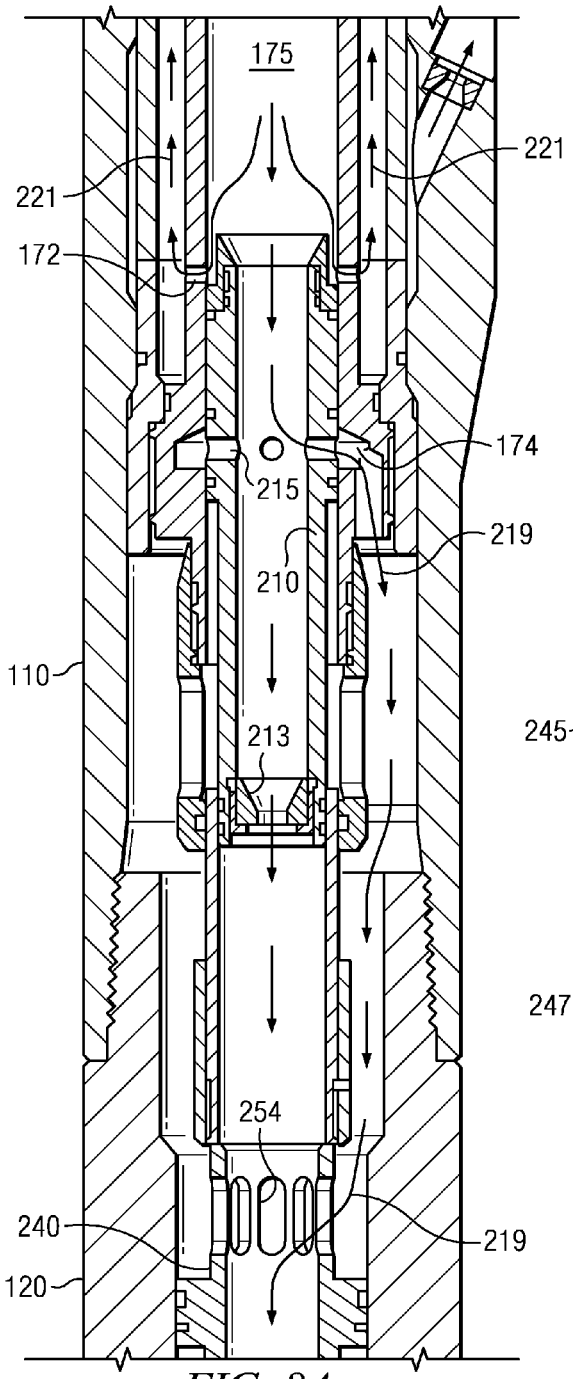
Figure 8B:
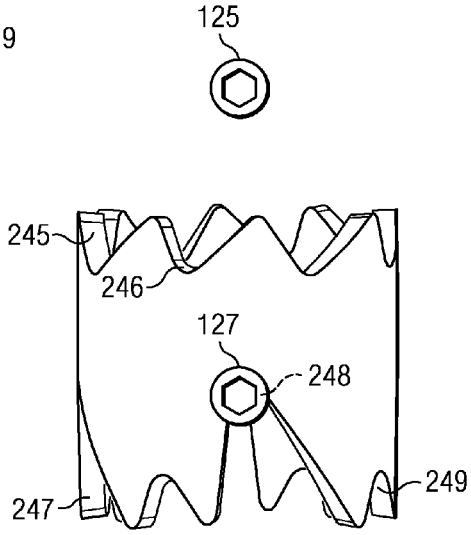

In FIGS. 8A and 8B, the assembly 100 is in a third operational mode, in which high flow is provided and the downhole tool is activated. To switch the assembly to the third mode, high (or full) flow is turned on at the wellbore surface. The increased flow urges valve piston 210 and cam piston 240 in the downhole direction such that downhole guide pins 127 engage surface 247 thereby further rotating the cam piston until the pins engage corresponding deep troughs 248. Engagement of the guide pines 127 with the deep troughs 248 allows the cam piston 240 and valve piston 210 to have a longer stroke length than that described above with respect to FIGS. 6A and 6B. In the configuration depicted on FIGS. 8A and 8B, fluid communication is provided between central bore 175 and mandrel port 172 (as indicated by arrows 221) thereby activating the downhole tool. Moreover, in the exemplary embodiment depicted, ports 215 are axially aligned with ports 214 allowing a portion of the drilling fluid flow to bypass nozzle 213 (e.g., as indicated by arrows 219). While the invention is not limited in this regard, such a bypass mechanism causes a pressure drop in the central bore that may be advantageously detected at the surface and taken by an operator as an indication of downhole tool activation.

Figure 9A:
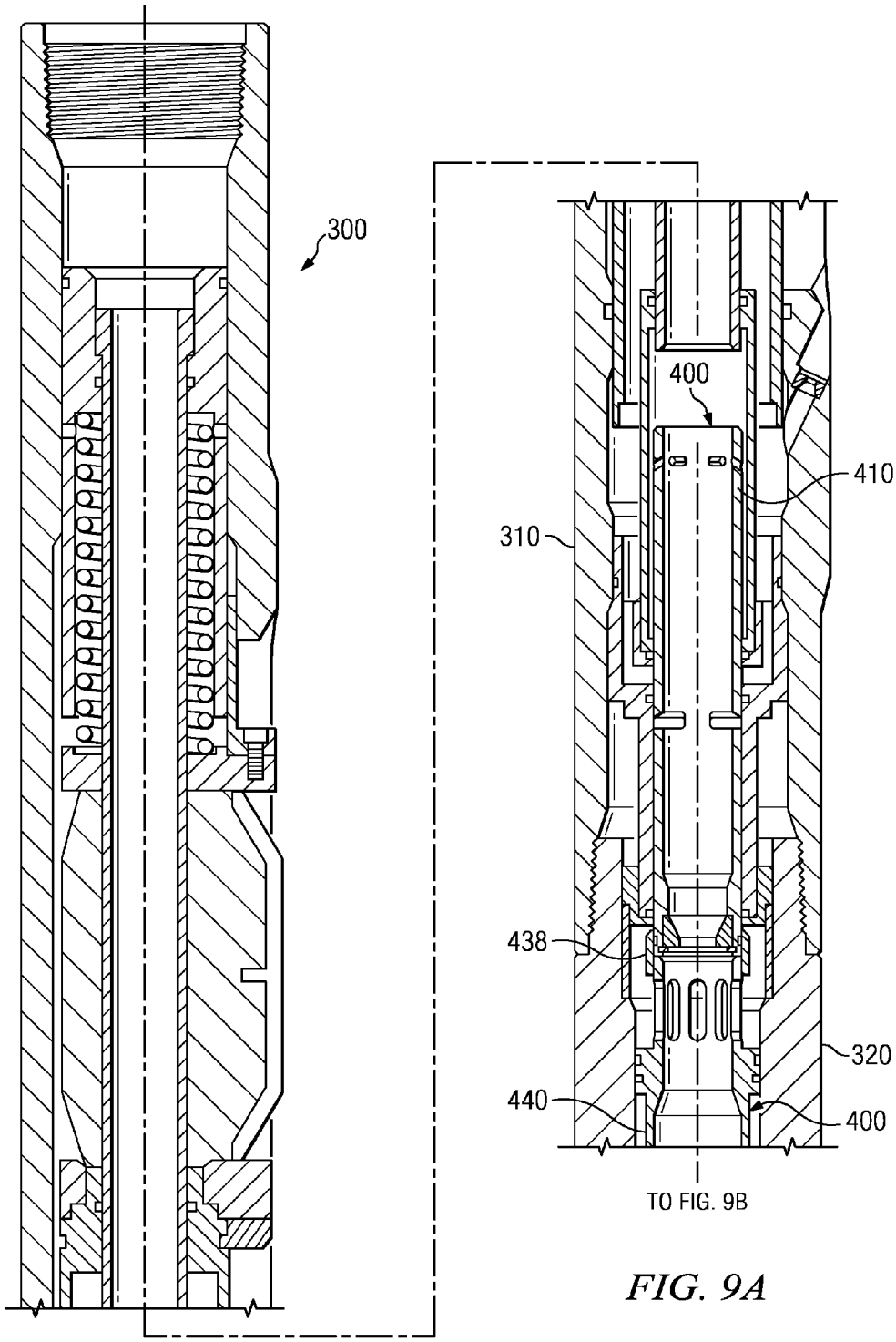
FIGS. 9A and 9B (collectively FIG. 9) depict a longitudinal cross sectional view of an alternative hydraulically actuated tool assembly in accordance with the present invention.
Figure 9B:
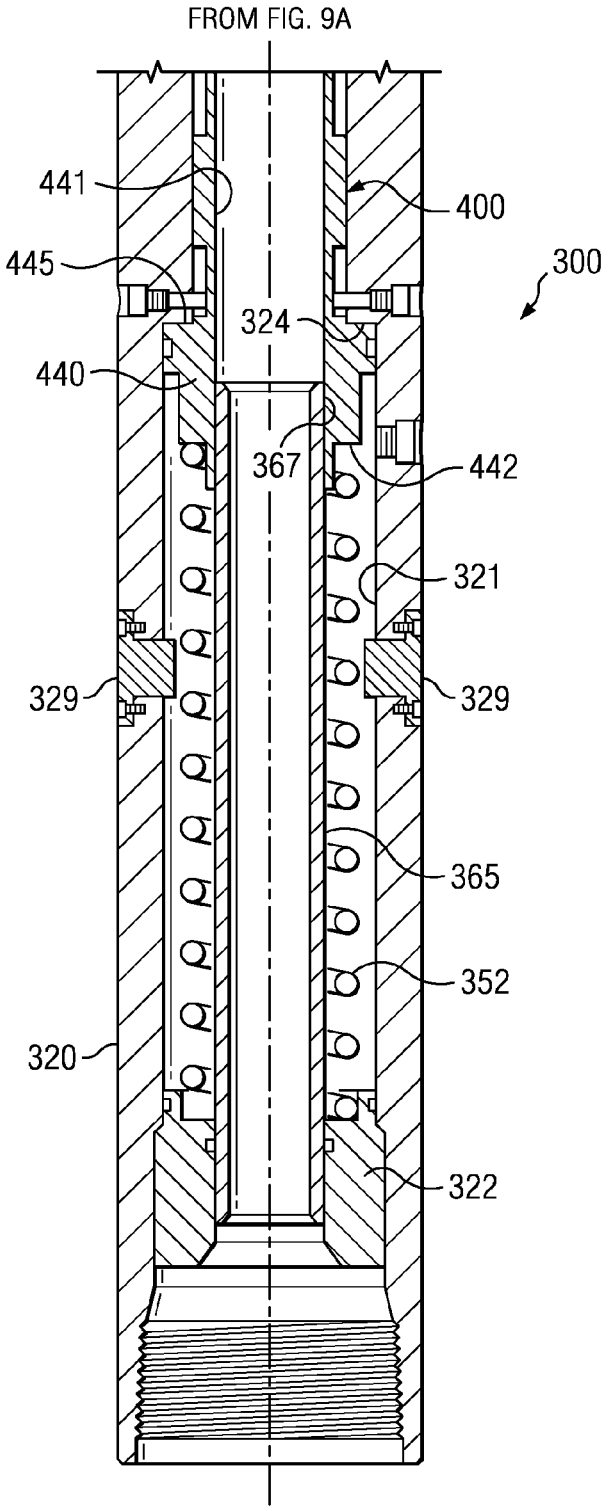

FIG. 9 depicts an alternative embodiment of a hydraulically actuated tool assembly 300 in accordance with the present invention in longitudinal cross section. In the exemplary embodiment depicted, the tool assembly 300 includes an underreamer tool body 310 connected to a sub body 320. While the alternative embodiment described herein is again specific to reamers, it will be understood that embodiments of the invention may be used to activate/deactivate various downhole tools. A piston assembly 400 is deployed substantially co-axially in the tool and sub bodies 310 and 320 and is configured to reciprocate axially therein. Piston assembly 400 includes a valve piston 410 connected to a cam piston 440 (e.g., via locking nut 438). A helical compression spring 352 is deployed axially between a lower face 442 of the cam piston 440 and a mandrel cap 322 deployed in the sub body 320. In the exemplary embodiment depicted, the cam piston 440 and the spring 352 are deployed about a cam mandrel 365, with an outer surface 367 of the mandrel 365 being sealingly engaged with an inner surface 441 of the cam piston 440. Compression spring 352 is configured to bias the cam piston 440 (and therefore assembly 400) in the uphole direction (towards the underreamer tool body 310).

Tool assembly 300 is similar to tool assembly 100 in that the piston assembly 400 is configured to reciprocate between a first low flow position and second and third high (or full) flow positions. In the low flow position, the spring force urges (biases) the assembly 400 in the uphole direction such that an uphole engagement face 445 engages internal shoulder 324 of sub body 320 (as depicted on FIGS. 9 and 10). In the second high flow position, fluid force exceeds the spring force and urges the assembly 400 in a downhole direction such that at least one shoulder portion 482 of the cam piston engages at least one stop block 329 (see FIG. 11). In the third high flow position, fluid force again exceeds the spring force and urges the assembly 400 in a downhole direction such that the stop block 329 slides past the shoulder portion 482 of the cam and engages cam slot 484 (see FIG. 16). In the exemplary embodiment depicted, the stop blocks 329 are deployed in corresponding recesses formed in the sub body and extend radially into the central bore 321 of the sub body 320 where they may engage the cam piston 440 as described above.

Figure 10:
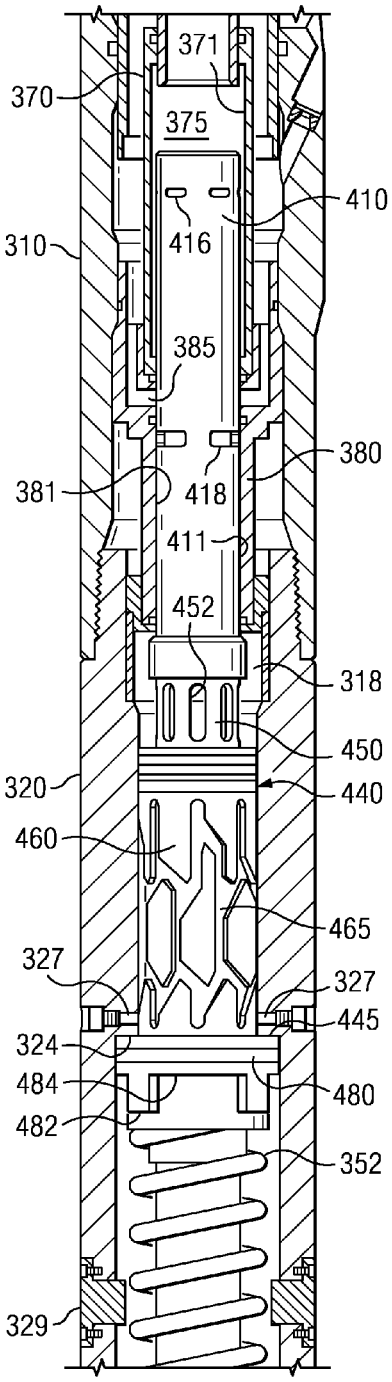
FIG. 10 depicts a partial cross sectional view of a portion of the tool assembly depicted on FIG. 9 in a first operational mode.

FIG. 10 depicts a partial cross section of tool assembly 300 in the low flow configuration. In the exemplary embodiment depicted valve piston 410 is deployed substantially co-axially in and sealingly engaged with mandrel sleeve 370 and mandrel 380. Valve piston 410 includes first and second axially spaced sets of circumferentially spaced ports 416 and 418. In the low flow configuration depicted on FIGS. 9 and 10, ports 416 are sealingly engaged with an inner surface 371 of mandrel sleeve 370 (i.e., such that they are axially misaligned with mandrel ports 385) and ports 418 are sealingly engaged with an inner surface 381 of the mandrel 380. Moreover, as depicted the mandrel ports 385 formed in the mandrel 380 are sealingly engaged with outer surface 411 of valve piston 410 such that there is no fluid communication between ports 385 and the through bore 375. As described in more detail below, tool actuation requires that the valve piston be translated axially such that the first set of ports 416 (the uphole ports) become axially aligned with mandrel ports 385. Such alignment provides fluid communication between the internal bore 375 and the downhole tool via the lower mandrel ports 385.

With continued reference to FIG. 10, cam piston 440 is deployed in and sealingly engaged with sub body 320. The exemplary cam piston embodiment 440 depicted includes first, second, and third axial portions 450, 460, and 480 having distinct outer diameters. The first portion 450 of the cam piston includes a plurality of circumferentially spaced apertures 452 configured to provide fluid communication between the internal bore of the cam and an annular area 318 formed internal to the tool and sub bodies 310 and 320. A second portion 460 of the cam piston includes a plurality of cam grooves 465 formed in an outer surface thereof. The cam grooves 465 are configured to engage one or more guide pins 327 that extend radially inward from the sub body 320. In the exemplary embodiment depicted, four guide pins 327 are circumferentially spaced at 90 degree intervals about the sub body (although the invention is not limited in this regard). The guide pins 327 are configured to travel within the cam grooves 465 and rotate the cam piston 440 and the valve piston 410 as the piston assembly 400 reciprocates axially. A third portion 480 of the cam piston, having an enlarged diameter and a plurality of lower cam slots 484, is configured to engage at least one stop block 329. In the exemplary embodiment depicted, four stop blocks 329 are circumferentially spaced at 90 degree intervals about the sub body (the invention is again not limited in this regard). The guide pin/cam groove and stop block/cam slot interactions are discussed in more detail below with respect to the activation and deactivation mechanisms.

Downhole tool actuation and deactuation is now described in more detail with respect to FIGS. 11 through 17. Actuation system 300 is similar to actuation system 100 (FIGS. 3-8) in that it enables a downhole tool to be selectively switched between the three aforementioned modes of operation. However, actuation system 300 differs from actuation system 100 in the particular steps required to actuation and deactuate the downhole tool. In actuation system 100, changing the drilling fluid flow rate to a low flow state and then back to a high (or full) flow state changes actuation modes (from deactivated to activated or from activated to deactivated). This may be accomplished, for example, via cycling the mud pumps off and then back on. Actuation system 300 differs from actuation system 100 in that such cycling of the mud pumps is insufficient to activate or deactivate the downhole tool. In actuation system 300 the mud pumps may be cycled substantially any number of times without changing the tool mode (i.e., without activating or deactivating the downhole tool). As described in more detail below, actuation (or deactuation) of actuation system 300 requires a fourth mode to be employed, referred to herein as an indexing mode that makes use of a corresponding index (indexing) flow.

Figure 11:
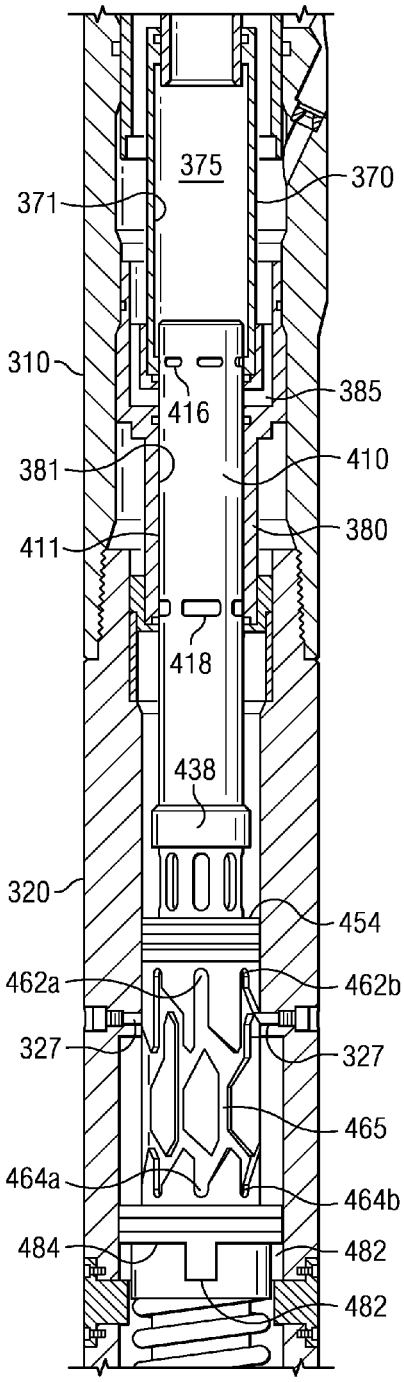
FIG. 11 depicts a partial cross sectional view of a portion of the tool assembly depicted on FIG. 9 in a second operational mode.

In FIG. 11, assembly 300 is depicted in a second mode, in which high (or full) full flow is provided while the downhole tool remains inactive. To switch the assembly 300 from the first mode (low flow) to the second mode, high (or full) flow is turned on at the wellbore surface. Increasing the pressure beyond a predetermined threshold overcomes the spring bias and urges the cam piston 440 in the downhole direction. The increased flow (pressure) acts, for example, on uphole face 454 of cam piston 440 thereby urging valve piston 410 and cam piston 440 in the downhole direction such that shoulders 482 engage stop blocks 329. Engagement of the guide pins 327 with cam groove 465 rotates the cam piston 440 (due to the profile of the groove) as described in more detail below. In the exemplary embodiment depicted, valve piston 410 and cam piston 440 are connected to one another (e.g., via locking nut 438) and therefore rotate together, although the invention is not limited in this regard.

Despite valve piston 410 being urged downhole with cam piston 440, ports 416 remain sealingly engaged with the inner surface 371 of mandrel sleeve 370 (i.e., such that they are axially misaligned with ports 385). Ports 418 also remain sealingly engaged with the inner surface 381 of mandrel 380. Moreover, as also depicted the mandrel ports 385 remain sealingly engaged with the outer surface 411 of valve piston 410. Therefore, the downhole tool remains inactive (in the deactuated state) while substantially full flow is provided through the bore, for example, to a drill bit for a drilling operation.

As described above, cycling the mud pumps between high and low flow is insufficient to activate and deactivate the downhole tool. The mud pumps may be cycled substantially any number of times such that the tool cycles between the first and second operational modes depicted on FIGS. 10 and 11 without activating the downhole tool. The exemplary cam piston embodiment depicted includes a groove pattern having a plurality of upper and lower axial end portions 462 and 464. In the exemplary embodiment depicted, half of the axial end portions 462*a* and 464*a* are circumferentially aligned with corresponding cam shoulders 482 and the other half 462*b* and 464*b* are circumferentially aligned with corresponding cam slots 484 (and therefore misaligned with the cam shoulders 482). The axial portions 462*a* and 464*a* that are aligned with the cam shoulders 482 alternate with the axial portions 462*b* and 464*b* that are aligned with the cam slots 484.

Figure 12:
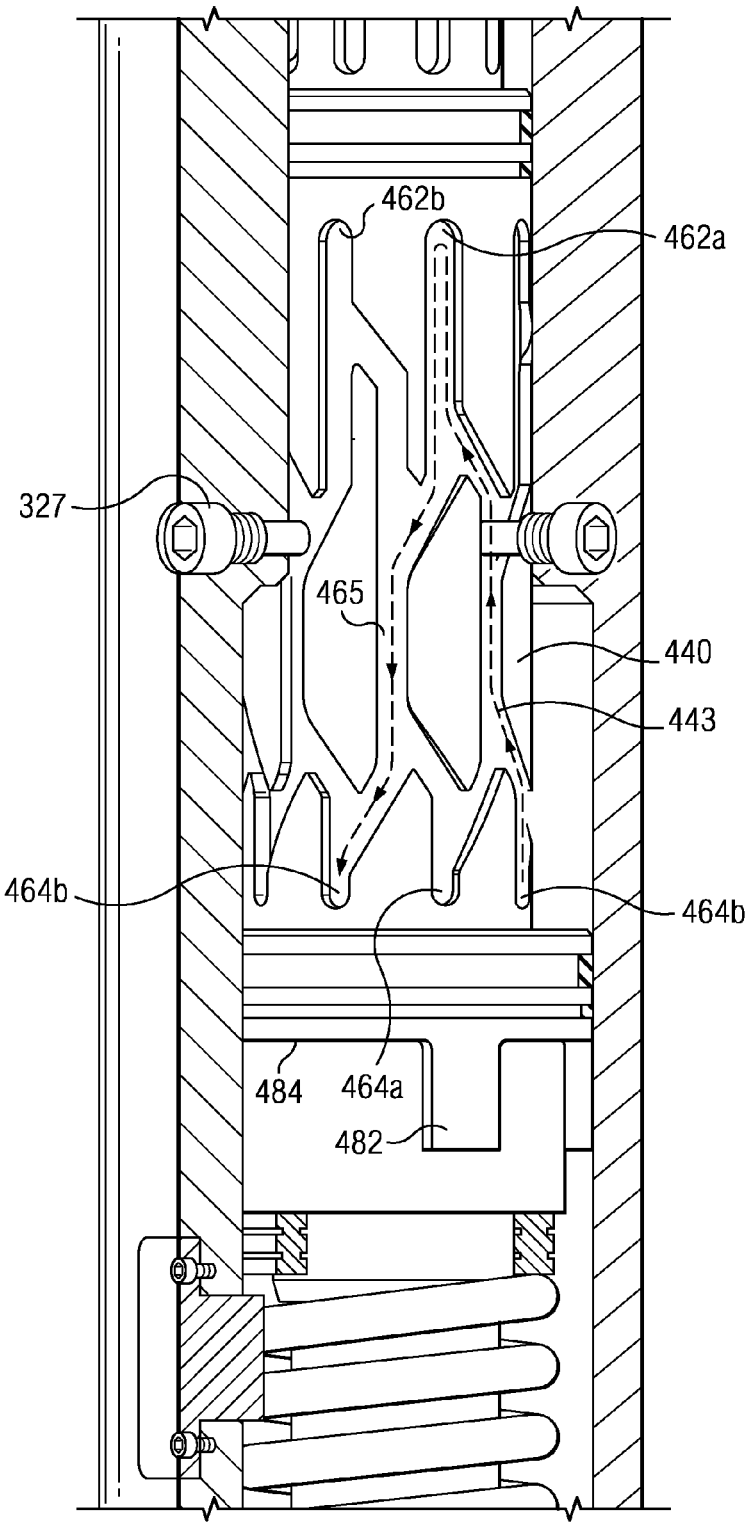
FIG. 12 depicts a side view of a cam piston portion of the tool assembly depicted on FIG. 9 showing the path of a guide pin during an exemplary flow rate cycle.

FIG. 12 provides a closer view of cam piston 440 and depicts (dashed line 443) relative motion of guide pins 327 in cam grooves 465 during a mud pump cycle (from low flow to high flow and back to low flow). The guide pins 327 are initially located in a lower axial end portion 464*b* of the cam groove that is circumferentially aligned with a cam slot 484. Increased flow urges the cam piston 440 downward causing the guide pins 327 to travel along the groove 465 to upper axial end portion 462*a* as indicated by the dashed line 443. Movement of the cam piston 440 past the guide pins 327 rotates the cam through an angle of 45 degrees in the exemplary embodiment depicted such that the guide pin(s) 327 are now aligned with cam shoulders 482 (see FIG. 10). In this mode, the tool assembly remains deactivated (FIG. 11) while high flow is provided. Decreasing fluid flow allows the cam piston 440 to move upwards via spring bias causing the guide pins 327 to travel along groove 465 to lower axial end portion 464*b* as further indicated by the dashed line 443. Movement of the cam piston 440 past the guide pins 327 further rotates the cam piston by an additional 45 degrees such that it is again aligned with an adjacent cam slot 484. Irrespective of the number of high-low mud pump cycles, the guide pin(s) always return to the same alignment after each cycle (i.e., circumferentially aligned with a slot or a shoulder). In this way, repeated cycling is insufficient to activate and/or deactivate the downhole tool (i.e., is insufficient to change the operational mode of the tool).

Figure 13:
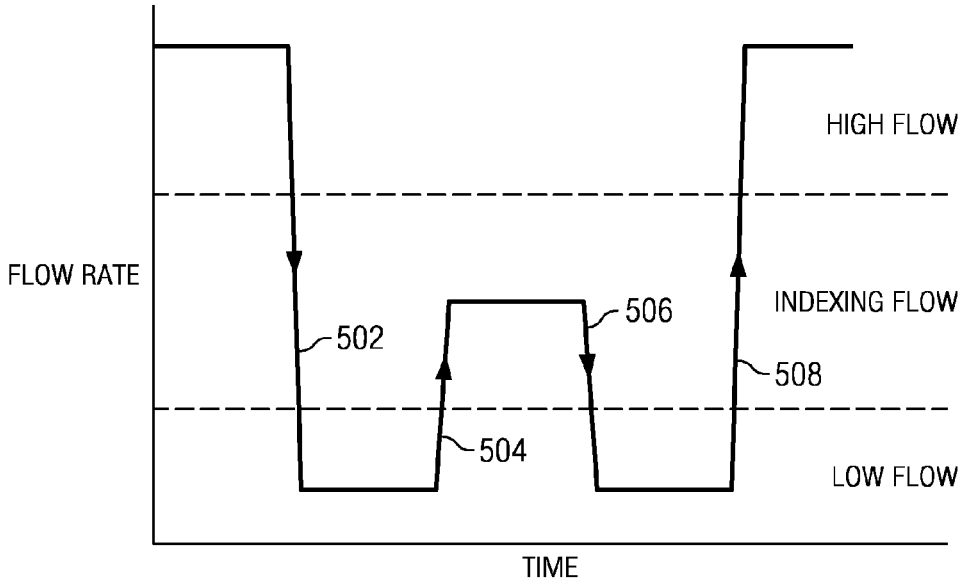
FIG. 13 depicts a plot of drilling fluid flow rate versus time for an exemplary indexing cycle.

In the exemplary embodiment depicted, actuation of the downhole tool requires indexing of the cam such that the guide pins 327 move from one axial end portion of the cam groove to an adjacent axial end portion (from end portion 462*a* to end portion 462*b* or from end portion 462*b* to end portion 462*a*). This is typically accomplished as shown schematically on FIG. 13 by (i) decreasing the flow rate 502 from high flow to low flow thereby returning the tool to the first mode as depicted on FIG. 10, (ii) increasing the flow rate 504 from low flow to an intermediate 'indexing' flow rate, (iii) decreasing the flow rate 506 from the indexing flow to the low flow, and (iv) increasing the flow rate 508 from low flow back to high flow. It will be understood that FIG. 13 is schematic in nature. It is not intended to indicate any particular required or preferred timing. Nor is it intended to indicate that an indexing plateau between 504 and 506 is required or preferred.

Figure 14:
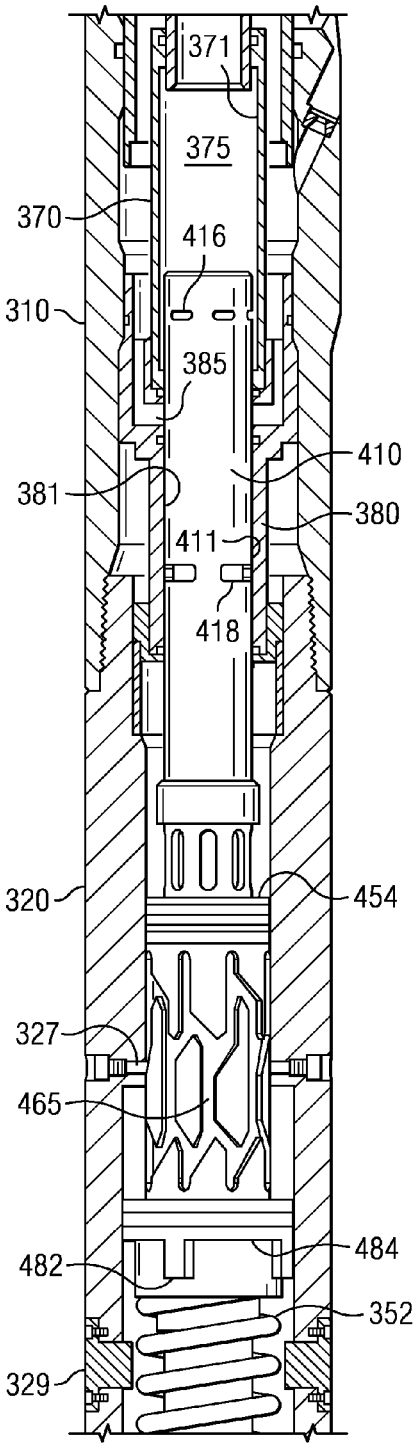
FIG. 14 depicts a partial cross sectional view of a portion of the tool assembly depicted on FIG. 9 in an indexing mode.

In FIG. 14, assembly 300 is depicted in the indexing mode, in which an intermediate (indexing) flow is provided while the downhole tool is inactive. The intermediate flow provides sufficient fluid force to partially overcome the spring bias such that assembly 400 is in an intermediate axial position balanced between the fluid force and the spring force. In the indexing mode, ports 416 remain sealingly engaged with the inner surface 371 of mandrel sleeve 370 (i.e., such that they are axially misaligned with ports 385). Ports 418 also remain sealingly engaged with the inner surface 381 of the mandrel 380. Moreover, as also depicted the mandrel ports 385 remain sealingly engaged with the outer surface 411 of valve piston 410 such that the tool remains inactive.

Figure 15:
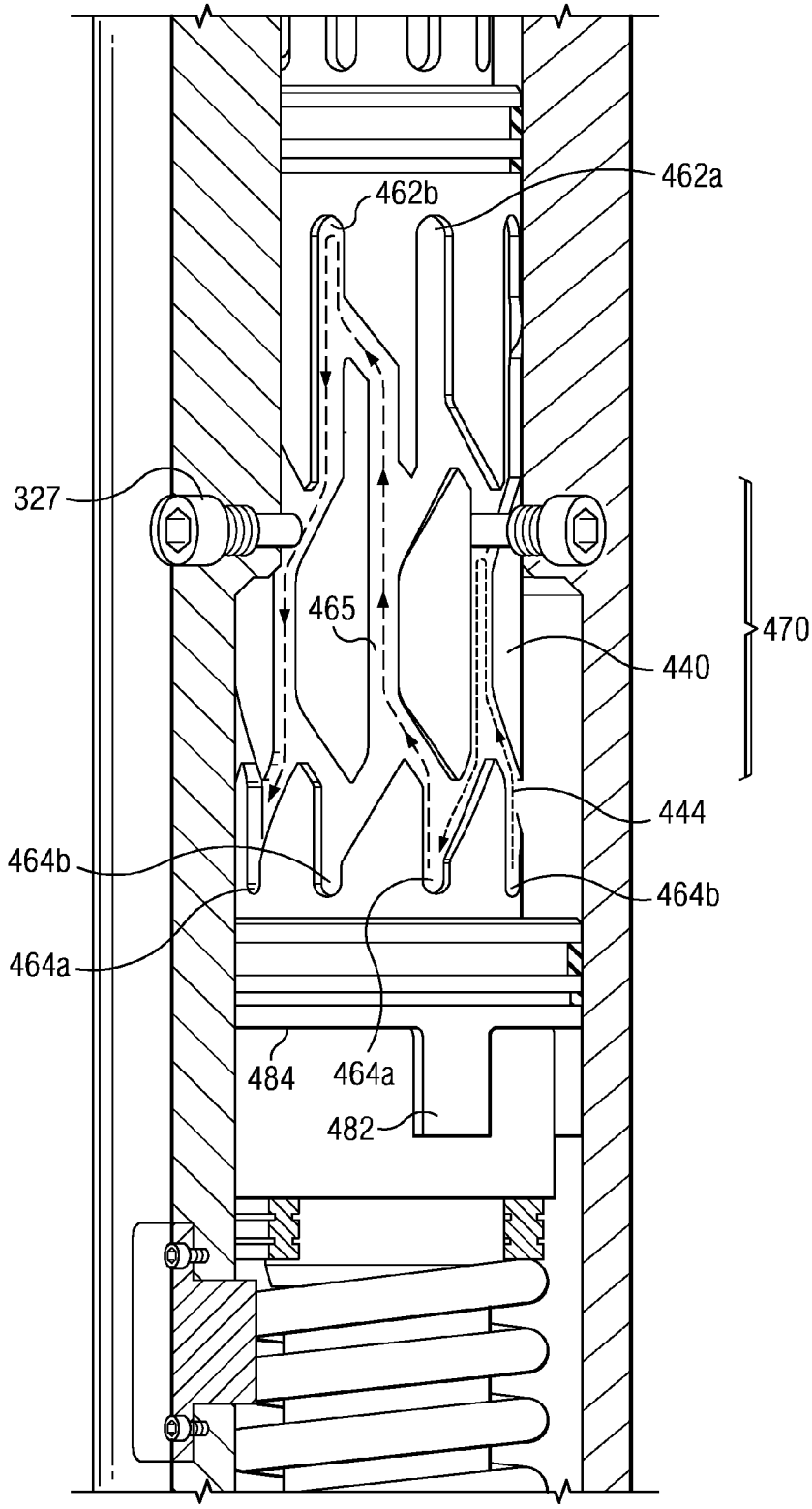
FIG. 15 depicts a side view of a cam piston portion of the tool assembly depicted on FIG. 9 showing the path of a guide pin during an exemplary indexing cycle.

FIG. 15 provides a closer view of cam piston 440 and depicts (dotted line 444) relative motion of guide pins 327 in the cam grooves 465 during an indexing cycle in which the mud pumps are cycled from low flow to indexing flow and back to low flow (e.g. as depicted at 504 and 506 on FIG. 13). In the exemplary embodiment depicted, the guide pins 327 are initially located in a lower axial end portion 464*b* of the cam groove 465 that is circumferentially aligned with a cam slot 484. Increased flow urges the cam piston downward causing the guide pin 327 to travel along the groove 465 into the indexing range 470 as indicated by the dotted line 444. Fluid flow is then reduced (or stopped) allowing the piston 440 to return to its biased position and allowing the guide pin 327 to travel back the adjacent axial end portion 464*a* (aligned with the cam shoulder 482) as further indicated by the dotted line 444. The guide pins 327 rotate the cam 440 through an angle of 45 degrees in the exemplary indexing cycle depicted. The flow rate may then be increased to full flow to actuate the downhole tool (as indicated by the dashed line 443 showing movement of pins 327 to upper axial end portion 462*b*).

Figure 16:
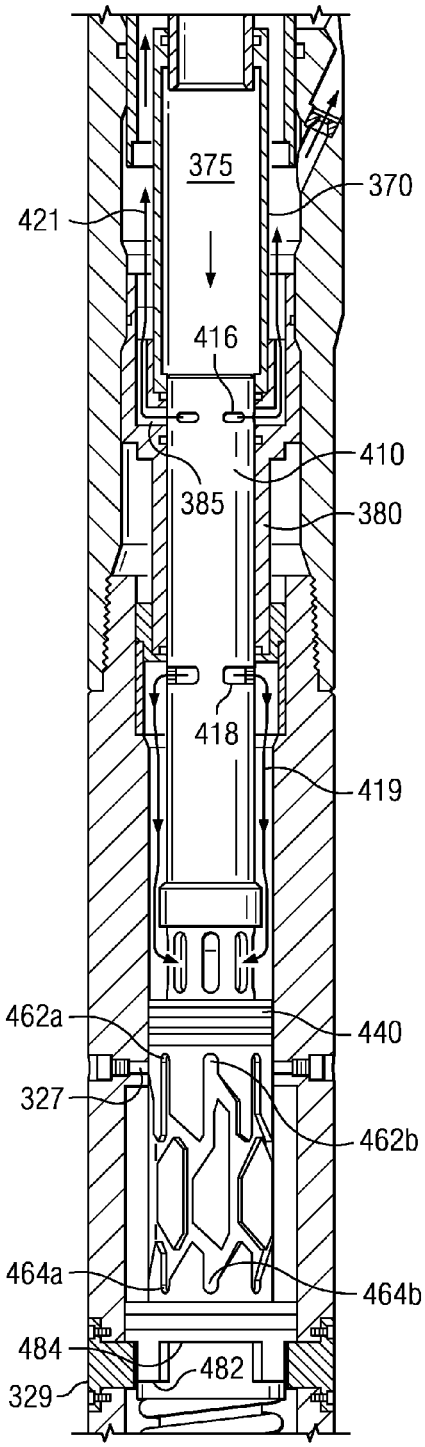
FIG. 16 depicts a partial cross sectional view of a portion of the tool assembly depicted on FIG. 9 in a third operational mode.

In FIG. 16, the assembly 300 is depicted in the third operational mode, in which full flow is provided and the downhole tool is activated (e.g., after the indexing cycle depicted on FIG. 15). Full flow urges valve piston 410 and cam piston 440 in the downhole direction such that cam slots 484 engaged stop blocks 329. Engagement of the cam slots 484 with the stop blocks 329 allows the cam piston 440 and valve piston 410 to have a longer stroke length than that described above with respect to FIG. 11. As such, ports 416 are axially aligned with mandrel ports 385 thereby enabling fluid communication between the central bore and mandrel ports 385 (as indicated by arrows 421) which in turn activates the downhole tool. Moreover, ports 418 are in fluid communication with annular region 318 allowing a portion of the drilling fluid flow to bypass nozzle 413. The fluid that flows into the annular region 318 flows axially down hole and then radially inward through apertures 452 and back into the central bore of the assembly (as indicated by arrows 419). While the invention is not limited in this regard, such a bypass mechanism causes a pressure drop in the central bore that may be advantageously detected at the surface and taken by an operator as an indication of downhole tool activation. It will be understood that the invention is not limited to any particular nozzle size or even to the use of a nozzle as shown in the depicted embodiments.

Figure 17:
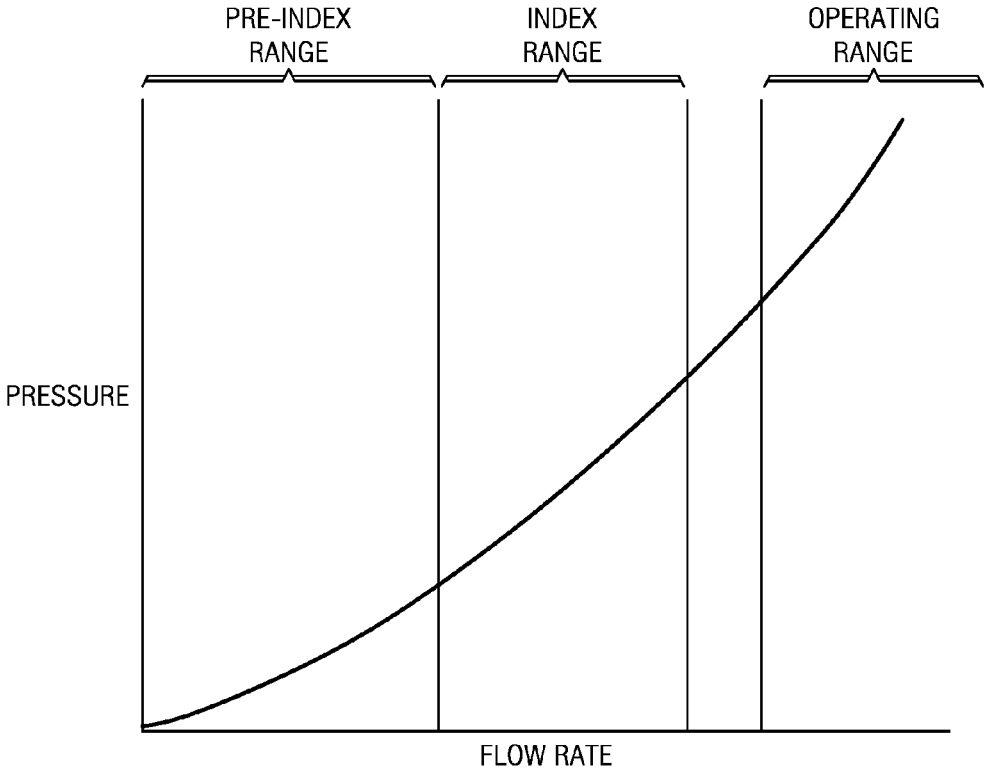
FIG. 17 depicts a plot of drilling fluid pressure versus flow rate for an exemplary tool assembly configuration.

FIG. 17 depicts a plot of drilling fluid pressure versus flow rate for exemplary tool assembly embodiments. In general, the drilling fluid pressure increases essentially monotonically with increasing flow rate (as would be expected by those of ordinary skill in the art). FIG. 17 depicts three general flow rate ranges. In the pre-index range the flow rate (and pressure) tends to be insufficient to overcome the spring bias and therefore the assembly remains in the first operational mode (FIG. 10). In the index range, the flow rate (and pressure) is sufficiently high to partially overcome the spring bias and therefore the assembly is in the indexing mode (FIG. 14). In the operating range, the flow rate (and pressure is sufficiently high to fully overcome the spring bias and therefore the assembly is in either the second operational mode (FIG. 11) or the third operational mode (FIG. 16).

In one exemplary embodiment of the invention an indexing flow rate may be in the range from about 400 to about 600 gallons per minute. In this particular embodiment, a flow rate of less than about 400 gallons per minute is in the pre-index range, while a flow rate greater than about 600 gallons per minute is in the operating range (or in a transitional range between the index range and operating range). It will be understood that the invention is not limited to any particular flow rates and/or pressures and that those of ordinary skill in the art would be readily able to compute suitable flow rates based on various tool geometry parameters (e.g., the tool diameter).

Although the present invention and its advantages have been described in detail, it should be understood that various changes, substitutions and alternations can be made herein without departing from the spirit and scope of the invention as defined by the appended claims.

We claim:

1. A downhole tool assembly comprising:

a downhole tool body having a through bore and configured for connecting with a drill string;

a mandrel deployed in the tool body, the mandrel including at least one port;

a piston assembly deployed in the mandrel, the piston assembly having the through bore extending therethrough, and the piston assembly including at least a valve piston and a cam piston configured to reciprocate axially in the mandrel between a first axial position and second and third axial positions opposing the first axial position, wherein the piston assembly is configured to actuate between the first and second axial positions when a guide pin coupled to the tool body is disposed within a first grooved track in the cam piston and when first and second flow rates are introduced to the through bore, respectively, wherein the piston assembly is configured to actuate between the first and third axial positions when the guide pin is disposed within a second grooved track in the cam piston, and wherein the guide pin transitions from the first grooved track to the second grooved track when a third flow rate is introduced to the through bore that is between the first flow rate and the second flow rate; and a spring member deployed in the tool body and disposed to bias the piston assembly towards the first axial position, wherein said mandrel port is in fluid communication with the through bore when the piston assembly is in the third axial position, the mandrel port being sealingly engaged with an outer surface of the piston assembly when the piston assembly is in either the first axial position or the second axial position, and fluid flow being permitted through the through bore when the piston assembly is in the first axial position, the second axial position, and the third axial position.

2. The tool assembly of claim 1, further comprising a plurality of cutting structures deployed in the tool body, the cutting structures configured to extend radially outward from the tool body when the piston assembly is in the third axial position and to retract radially inward when the piston assembly is in either the first axial position or the second axial position.

3. The tool assembly of claim 1, wherein the piston assembly is configured such that drilling fluid flow in the through bore urges the piston assembly against the bias of the spring member.

4. The tool assembly of claim 1, wherein:

the cam piston comprises first and second cam profiles, the first cam profile facing in an uphole direction and the second cam profile facing in a downhole direction.

5. The tool assembly of claim 4, wherein:

the second cam profile comprises circumferentially spaced, alternating deep and shallow troughs; and the guide pin engages a corresponding one of the shallow troughs when the piston assembly is in the second axial position and a corresponding one of the deep troughs when the piston assembly is in the third axial position.

6. The tool assembly of claim 4, wherein the piston assembly is configured to reciprocate from the second axial position to the first axial position and then back to the second axial position when a drilling fluid flow rate is cycled from the second flow rate to the first flow rate and back to the second flow rate.

7. The tool assembly of claim 1, wherein:

the cam piston comprises circumferentially spaced, alternating cam slots and cam shoulders formed on one axial end of the cam piston; and the tool body comprises at least a first stop block configured to engage at least one of the cam shoulders when the piston assembly is in the second axial position and at least one of the cam slots when the piston assembly is in the third axial position.

8. The tool assembly of claim 7, wherein the piston assembly is configured to reciprocate from the second axial position to the first axial position and back to the second axial position when a drilling fluid flow rate is cycled from the second flow rate to the first flow rate and back to the second flow rate.

9. The tool assembly of claim 7, wherein the piston assembly is configured to reciprocate from the second axial position to the first axial position and then to the third axial position when a drilling fluid flow rate is cycled from the second flow rate, to the first flow rate, to the third flow rate, back to the first flow rate, and then to the second flow rate.

10. The tool assembly of claim 1, wherein:

the valve piston comprises at least one port; and said valve piston port provides fluid communication between the through bore and an annular region between the tool body and a portion of the piston assembly when the piston assembly is in the third axial position, the valve piston port being sealingly engaged with an inner surface of the mandrel when the piston assembly is in either the first axial position or the second axial position.

11. The tool assembly of claim 10, wherein the valve piston port provides an alternative flow path around a nozzle deployed in the piston assembly when the piston assembly is in the third axial position, the alternative flow path routing drilling fluid from the through bore, through the annular region and back into the through bore.

12. The tool assembly of claim 11, wherein the cam piston comprises a plurality of apertures providing fluid communication between the annular region and the through bore.

13. The tool assembly of claim 1, wherein the third flow rate is greater than the first flow rate and less than the second flow rate.

14. The tool assembly of claim 1, wherein the third flow rate is in a preset range that is greater than the first flow rate and less than the second flow rate.

15. A downhole tool assembly comprising:

a downhole tool body having a through bore and being configured for connecting with a drill string;

a cam piston deployed in the tool body, the cam piston including first and second uphole and downhole facing cam profiles formed thereon, the cam piston configured to reciprocate axially in the tool body between a first axial position and second and third axial positions opposing the first axial position, wherein the cam piston is configured to actuate between the first and second axial positions when a guide pin coupled to the tool body is disposed within a first grooved track in the cam piston and when first and second flow rates are introduced to the through bore, respectively, wherein the cam piston is configured to actuate between the first and third axial positions when the guide pin is disposed within a second grooved track in the cam piston, and wherein the guide pin transitions from the first grooved track to the second grooved track when a third flow rate is introduced to the through bore that is between the first flow rate and the second flow rate;

a spring member deployed in the tool body and disposed to bias the cam piston towards the first axial position;

a radial fluid flow path being disposed to be in fluid communication with the through bore when the cam piston is in the third axial position and out of fluid communication with the through bore when the cam piston is in either the first axial position or the second axial position, and fluid flow being permitted axially through the through bore when the cam piston is in the first axial position, the second axial position, and the third axial position.

16. The tool assembly of claim 15, further comprising:

a mandrel deployed in the tool body; and a piston assembly including a valve piston and the cam piston, the piston assembly being deployed in the mandrel.

17. The tool assembly of claim 16, wherein the radial fluid flow path includes at least one port formed in the mandrel, the port being disposed to be in fluid communication with the through bore when the cam piston is in the third axial position and sealingly engaged with an outer surface of the piston assembly when the cam piston is in either the first axial position or the second axial position.

18. The tool assembly of claim 15, wherein:

the second cam profile comprises circumferentially spaced, alternating deep and shallow troughs; and the guide pin engages a corresponding one of the shallow troughs when the cam piston is in the second axial position and a corresponding one of the deep troughs when the cam piston is in the third axial position.

19. The tool assembly of claim 15, wherein the cam piston is configured to reciprocate from the second axial position to the first axial position and back to the second axial position when a drilling fluid flow rate is cycled from the second flow rate to the first flow rate and back to the second flow rate.

20. The tool assembly of claim 15, further comprising a plurality of cutting structures deployed in the tool body, the cutting structures configured to extend radially outward from the tool body when the radial fluid flow path is in fluid communication with the through bore.

21. A downhole tool assembly comprising:

a downhole tool body having a through bore and configured for connecting with a drill string;

a mandrel deployed in the tool body, the mandrel including first and second mandrel ports;

a piston assembly deployed in the tool body, the piston assembly having the through bore extending therethrough, and the piston assembly including at least a valve piston and a cam piston configured to reciprocate axially in the mandrel between a first axial position and second and third axial positions opposing the first axial position, wherein the piston assembly is configured to actuate between the first and second axial positions when a guide pin coupled to the tool body is disposed within a first grooved track in the cam piston and when first and second flow rates are introduced to the through bore, respectively, wherein the piston assembly is configured to actuate between the first and third axial positions when the guide pin is disposed within a second grooved track in the cam piston, and wherein the guide pin transitions from the first grooved track to the second grooved track when a third flow rate is introduced to the through bore that is greater than the first flow rate and less than the second flow rate;

a spring member deployed in the tool body and disposed to bias the piston assembly towards the first axial position; and the valve piston including a radial port formed therein, wherein a fluid flows from the through bore through the first mandrel port and to an annulus formed between the mandrel and the tool body when the piston assembly is in the third axial position causing the downhole tool assembly to actuate from an inactive state to an active state, wherein the fluid flows from the annulus to an exterior of the body through a tool body port, wherein the radial port is axially aligned with and in fluid communication with said second mandrel port when the piston assembly is in the third axial position, wherein the radial port is axially misaligned with the second mandrel port and sealingly engaged with an inner surface of the mandrel when the piston assembly is in either the first axial position or the second axial position, and wherein fluid flow is permitted through the through bore when the piston assembly is in the first axial position, the second axial position, and the third axial position.

22. The tool assembly of claim 21, further comprising a plurality of cutting structures deployed in the tool body, the cutting structures configured to extend radially outward from the tool body when the piston assembly is in the third axial position and to retract radially inward when the piston assembly is in either the first axial position or the second axial position.

23. The tool assembly of claim 21, wherein:

the cam piston comprises circumferentially spaced, alternating cam slots and cam shoulders formed on one axial end of the cam piston; and the tool body comprises at least a first stop block configured to engage at least one of the cam shoulders when the piston assembly is in the second axial position and at least one of the cam slots when the piston assembly is in the third axial position.

24. The tool assembly of claim 23, wherein the first and second grooved tracks comprise a plurality of upper and lower axial end portions, a first group of which are circumferentially aligned with a corresponding one of the cam shoulders and a second group of which are circumferentially aligned with a corresponding one of the cam slots.

25. The tool assembly of claim 24, wherein:

the guide pin engages an upper end portion of the first group when the piston assembly is in the second axial position; and the guide pin engages an upper end portion of the second group when the piston assembly is in the third axial position.

26. The tool assembly of claim 23, wherein the piston assembly is configured to reciprocate from the second axial position to the first axial position and back to the second axial position when a drilling fluid flow rate is cycled from the second flow rate to the first flow rate and back to the second flow rate.

27. The tool assembly of claim 23, wherein the piston assembly is configured to reciprocate from the second axial position to the first axial position and then to the third axial position when a drilling fluid flow rate is cycled from the second flow rate, to the first flow rate, to the third flow rate, back to the first flow rate, and then to the second flow rate.

28. The tool assembly of claim 21, wherein the fluid flows through the second mandrel port and the radial port into a second annulus formed between the valve piston and the tool body when the piston assembly is in the third axial position.

29. The tool assembly of claim 28, wherein the second annulus provides an alternative flow path around a nozzle deployed in the through bore of the piston assembly when the piston assembly is in the third axial position, the alternative flow path routing the fluid back into the through bore in the piston assembly.

30. The tool assembly of claim 29, wherein the cam piston comprises a plurality of apertures providing fluid communication between the second annulus and the through bore, the apertures being axially spaced from the second mandrel port.

* * * * *